US007267432B2

(12) United States Patent
Hibi et al.

(10) Patent No.: US 7,267,432 B2
(45) Date of Patent: Sep. 11, 2007

(54) INK-JET HEAD

(76) Inventors: Manabu Hibi, c/o Technology Planning & IP Dept., Brother Kogyo Kabushiki Kaisha, 1-1-1 Kawagishi, Mizuho-ku, Nagoya-shi, Aichi 467-8562 (JP); Atsuo Sakaida, c/o Technology Planning & IP Dept., Brother Kogyo Kabushiki Kaisha, 1-1-1 Kawagishi, Mizuho-ku, Nagoya-shi, Aichi 467-8562 (JP)

( * ) Notice: Subject to any disclaimer, the term of this patent is extended or adjusted under 35 U.S.C. 154(b) by 374 days.

(21) Appl. No.: 11/067,641

(22) Filed: Feb. 28, 2005

(65) Prior Publication Data

US 2005/0200663 A1 Sep. 15, 2005

(30) Foreign Application Priority Data

Feb. 27, 2004 (JP) ..... 2004-053412

(51) Int. Cl.
*B41J 2/045* (2006.01)

(52) U.S. Cl. ..... 347/68; 347/70

(58) Field of Classification Search ..... 347/20, 347/68–71

See application file for complete search history.

(56) References Cited

U.S. PATENT DOCUMENTS 5,402,159 A 3/1995 Takahashi et al. ..... 347/9
6,984,027 B2 * 1/2006 Sakaida et al. ..... 347/68
2004/0113994 A1 * 6/2004 Shinkai ..... 347/68

FOREIGN PATENT DOCUMENTS

JP A 4-341852 11/1992

* cited by examiner

*Primary Examiner*—Juanita D. Stephens
(74) *Attorney, Agent, or Firm*—Oliff & Berridge, PLC

(57) ABSTRACT

Each actuator unit is a lamination of four piezoelectric sheets, and individual electrodes are provided on the piezoelectric sheet. Each individual electrode includes a main electrode region disposed at such a position to be opposed to a pressure chamber and a connection electrode region extending on one side of the main electrode region and has a land on its surface. The individual electrode is formed with auxiliary electrode portions extending from a portion of the main electrode region close to the boundary between the main electrode region and the connection electrode region toward two other individual electrodes, respectively, located adjacent to the individual electrode concerned on both sides of the land. The auxiliary electrode portions are provided with proximate portions close to the two other individual electrodes, respectively, and are opposed to pressure chambers opposed to the two another individual electrodes, respectively.

11 Claims, 14 Drawing Sheets

INK-JET HEAD

BACKGROUND OF THE INVENTION

1. Field of the Invention

The present invention relates to an ink-jet head that discharges ink droplets toward a recording medium to perform printing thereon.

2. Description of the Related Art

In an ink-jet head which is used in an ink-jet printer or the like, ink that is supplied from an ink tank is distributed to a plurality of pressure chambers and pulse pressures are selectively applied to the individual pressure chambers, whereby ink droplets are discharged from nozzles. One means for selectively applying pressures to the pressure chambers is an actuator unit having a lamination of a plurality of piezoelectric sheets made of piezoelectric ceramics.

Among the conventional ink-jet heads of the above kind is one having one actuator unit in which a plurality of continuous flat plates as piezoelectric sheets that cover a plurality of pressure chambers are laminated on each other and at least one of those piezoelectric sheets is interposed between a common electrode that is common to many pressure chambers and is kept at the ground potential and many individual electrodes (drive electrodes) that are opposed to the respective pressure chambers (refer to JP-A-4-341852 (FIG. 1)). If an individual electrode corresponding to a certain portion of the piezoelectric sheet that is interposed between the individual electrode and the common electrode and polarized in the lamination direction is given a potential that is different than the common electrode, that portion expands or contracts in the longitudinal direction due to what is called the piezoelectric longitudinal effect because an external electric field develops there in the polarization direction of the piezoelectric sheet. In this case, the portion of the piezoelectric sheet interposed between the individual electrode and the common electrode serves as an active layer that is deformed according to the piezoelectric effect because of the development of the external electric field. As a result, the capacity of the associated pressure chamber is varied and an ink droplet is discharged toward a recording medium from a nozzle that communicates with the pressure chamber.

SUMMARY OF THE INVENTION

In the above ink-jet head, with a recent trend that the pressure chambers are arranged at a higher density to satisfy such requirements as increase in image resolution and printing speed, what is called structural crosstalk has become a problem, which is a phenomenon that when an active layer opposed to a certain pressure chamber is deformed, portions of the piezoelectric sheet that are opposed to the adjacent pressure chambers are also deformed, whereby ink droplets are discharged from ink jets that should not do so or the ink discharge amount becomes larger or smaller than a correct value.

It is an object of the invention to provide an ink-jet head capable of reducing the structural crosstalk.

As described above, where pressure chambers are arranged at a high density, in particular, adjacent to each other in matrix form, deformation having a displacement in a direction of obstructing uniform ink droplet discharge is transmitted to pressure chambers adjacent to a pressure chamber that has caused deformation of the piezoelectric sheet to discharge an ink droplet. Further, the present inventors have discovered that if there exists a land that extends from the individual electrode so as not to be opposed to the pressure chamber and serves as an input portion for a voltage to be applied to the individual electrode, the land causes deformation of a surrounding portion of the piezoelectric sheet, which is a factor of generating crosstalk that depends on positional relationships with the land. That is, the inventors have found that the influence of the land is not negligible because the land is closer to the adjacent pressure chambers than the individual electrode is from which the land extends. Since such structural crosstalk deteriorates the image quality of a printed image, to increase the image quality of an ink-jet printer it is very important to reduce the structural crosstalk.

According to one aspect of the invention, there is provided with an ink-jet head including: a flow passage unit in which a plurality of pressure chambers that communicate with respective nozzles are arranged parallel with a plane in matrix form; and an actuator unit fixed to one surface of the flow passage unit, for varying capacities of the respective pressure chambers, the actuator unit comprising a plurality of individual electrodes including a plurality of main electrode regions that are provided inside respective pressure chamber areas that are projections of the respective pressure chambers on the plane and connection electrode regions that are continuous with the respective main electrode regions and are to be connected to signal lines; a common electrode that covers all of an area where the pressure chambers are formed; and a piezoelectric sheet that covers the pressure chambers and is interposed between the common electrodes and the individual electrodes. Each of the individual electrodes is provided with an auxiliary electrode portion that is led out of the individual electrode toward another individual electrode adjacent to the individual electrode and has a proximate portion that is located close to the adjacent individual electrode inside a pressure chamber area corresponding to the adjacent individual electrode.

With the above configuration, even if strain of the portion of the piezoelectric sheet that is opposed to the individual electrode is transmitted to the portion of the piezoelectric sheet that is opposed to the adjacent individual electrode and gives it a capacity variation, strain of the portion of the piezoelectric sheet that is opposed to the proximate portion of the auxiliary electrode can give the adjacent pressure chamber an opposite capacity variation that cancels out the above capacity variation. As a result, the volumes and speeds of discharged ink droplets can be made almost uniform.

According to another aspect of the invention, the proximate portion of the auxiliary electrode portion may cause, in a pressure chamber corresponding to the adjacent individual electrode, a capacity variation that is opposite in direction to a capacity variation that is caused in the pressure chamber corresponding to the adjacent individual electrode by a connection electrode region of the individual electrode when a signal is applied to the individual electrode via a signal line. This measure makes it possible to reduce the structural crosstalk without causing useless increase in power consumption.

According to another aspect of the invention, the auxiliary electrode portion may be led out toward a main electrode region of the adjacent individual electrode and have the proximate portion at a tip of the auxiliary electrode portion. This measure makes it possible to effectively cancel out the influence of strain of the portion of the piezoelectric sheet opposed to the individual electrode on a capacity variation of the adjacent pressure chamber.

According to another aspect of the invention, the pressure chambers assume, in a plan view, a parallelogram shape having two acute angle portions, and a connection electrode region of the individual electrode extend from a position close to one of the acute angle portions of a pressure chamber corresponding to the individual electrode to outside a pressure chamber area corresponding to the individual electrode and be located between respective main electrode regions of two other individual electrodes that are adjacent to the individual electrode. This measure makes it possible to reduce the structural crosstalk even in the case where the pressure chambers are arranged at a high density.

In the above configuration, respective auxiliary electrode portions may be led out toward the two other individual electrodes that are located adjacent to the individual electrode on both sides of the connection electrode region. This measure makes it possible to effectively cancel out the influence on capacity variations of the two other pressure chambers adjacent to the connection electrode region.

In the above configuration, the proximate portion of the auxiliary electrode portion may be located inside the pressure chamber area corresponding to the adjacent individual electrode at a position close to the other acute angle portion where a connection electrode region is not disposed. This measure makes it possible to reduce the structural crosstalk effectively even in the case where the pressure chambers are arranged at a high density.

In this configuration, the auxiliary electrode portion may extend straightly from a position close to a boundary between the main electrode region and the connection electrode region toward the other acute angle portion of the pressure chamber corresponding to the adjacent individual electrode. This measure shortens the stretched portion and thereby makes it possible to reduce the voltage (power consumption) to be applied to the individual electrode via the signal line.

In the above configuration, the auxiliary electrode portion may extend from a position close to a boundary between the main electrode region and the connection electrode region so as to avoid an area adjoining an obtuse angle portion of the pressure chamber corresponding to the individual electrode. This measure prevents strain of the portion of the piezoelectric sheet opposed to the auxiliary electrode portion from giving useless capacity variations to the pressure chamber corresponding to the individual electrode and the pressure chamber corresponding to the adjacent individual electrode, and thereby makes it possible to reduce the structural crosstalk effectively.

DESCRIPTION OF THE PREFFERED EMBODIMENTS

Embodiments of the present invention will be hereinafter described with reference to the drawings.

Figure 1:
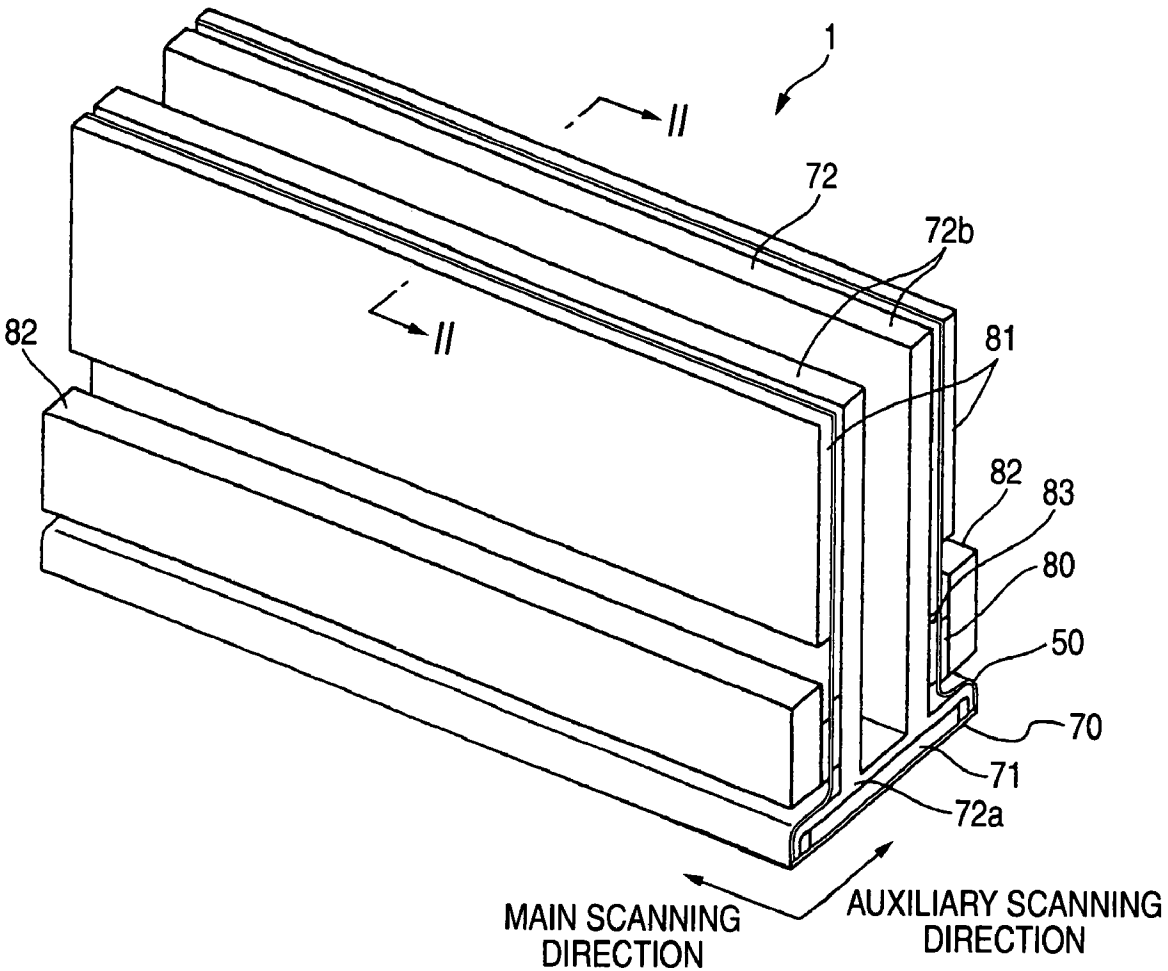
FIG. 1 is a perspective view showing an appearance of an ink-jet head according to a first embodiment of the present invention.
Figure 2:
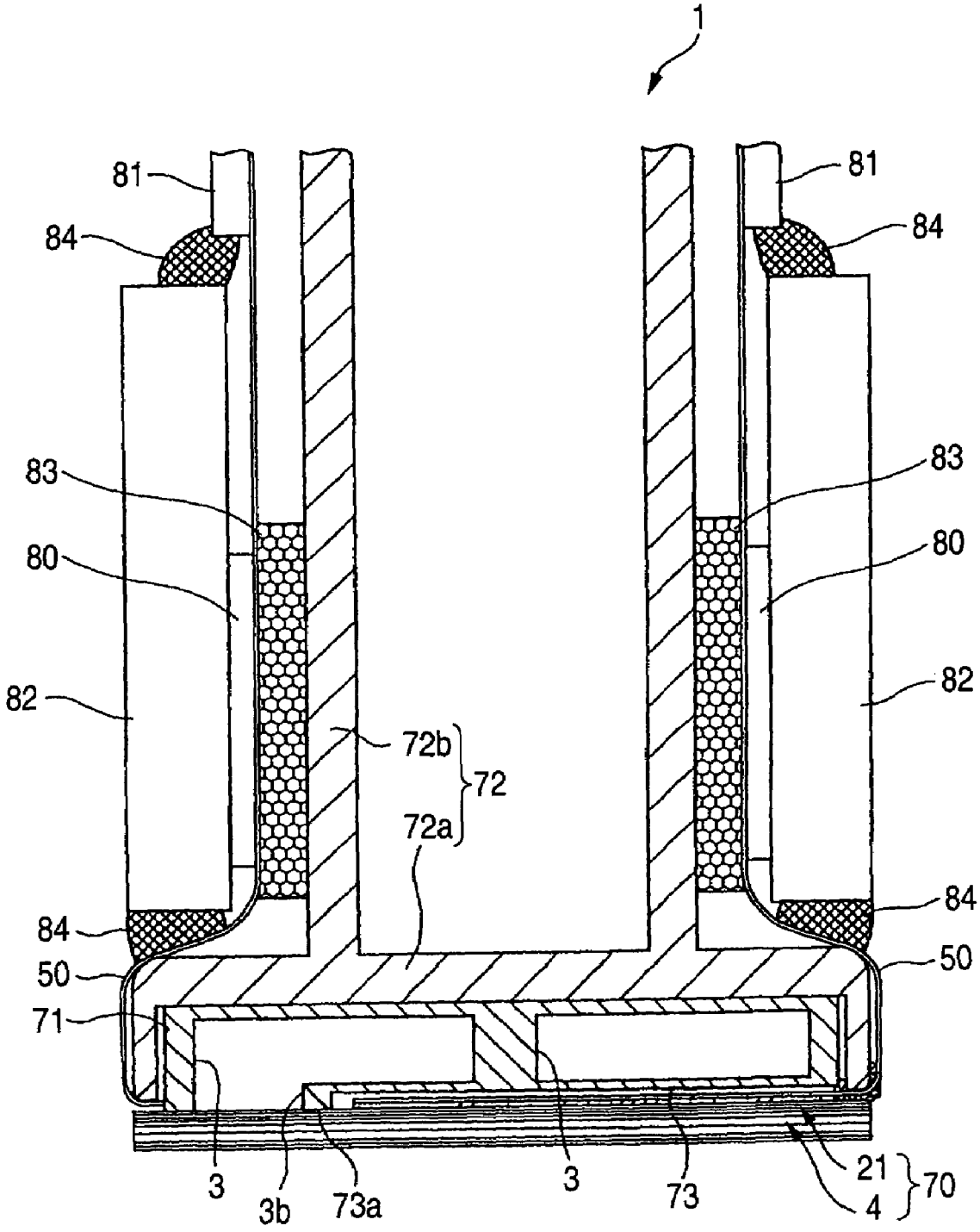
FIG. 2 is a sectional view taken along line II-II in FIG. 1.

FIG. 1 is a perspective view showing an appearance of an ink-jet head according to a first embodiment of the invention. FIG. 2 is a sectional view taken along line II-II in FIG. 1. Ink head 1 is equipped with a head main body 70 that is shaped like a rectangular flat plate, extends in the main scanning direction, and serves to discharge ink droplets toward a sheet and a base block 71 that is disposed over the head main body 70 and formed with two ink storages 3 of flow passages of ink that is supplied to the head main body 70.

The head main body 70 includes a flow passage unit 4 in which ink flow passages are formed and a plurality of actuator units 21 that are bonded to the top surface of the flow passage unit 4. Each actuator unit 21 is such as to be obtained by laying a plurality of thin plates on each other and bonding those to each other. FPC (flexible printed circuit) boards 50 as signal supplying members are bonded to the top surfaces of the actuator units, are led out to the right and left sides, and extend upward while being curved as shown in FIG. 2. The base block 71 is made of a metal material such as stainless steel. The ink storages 3 in the base block 71 are hollow spaces that generally assume a rectangular parallelepiped and extend in the longitudinal direction of the base block 71.

Proximate portions 73*a*, in close proximity to openings 3*b*, of a bottom surface 73 of the base block 71 are lower than portions around the proximate portions 73*a*. Only the proximate portions 73*a* of the bottom surface 73 of the base block 71 is in contact with the top surface of the flow passage unit 4 (also see FIG. 3). Therefore, the portions of the bottom surface 73 of the base block 71 other than the proximate portions 73*a* are separated from the head main body 70, and the actuator units 21 are disposed so as to be opposed to those separated portions.

A holder 72 includes a grip 72*a* that grips the base block 71 and a pair of projections 72*b* that are spaced in the auxiliary scanning direction and project upward from the top surface of the grip 72*a*. The base block 71 is placed in a bottom recess of the grip 72*a* of the holder 72 and bonded and fixed to the grip 72*a*. The FPC boards 50, which are bonded to the actuator units 21, extend parallel with the associated surfaces of the projections 72*b* of the holder 72 with elastic members 83 such as sponge interposed in between. Driver ICs 80 are mounted on the portions of the FPC boards 50 that extend parallel with the surfaces of the projections 72*b* of the holder 72. The FPC boards 50, which serve to transmit, to the actuator units 21 of the head main body 70, drive signals that are output from the driver ICs 80, are electrically connected to the actuator units 21 and the driver ICs 80 with solder.

Heat sinks 82 generally having a rectangular parallelepiped shape are disposed in close contact with the outside surfaces of the driver ICs 80, and hence heat generated by the driver ICs 80 can be dissipated efficiently. Substrates 81 are disposed above the driver ICs 80 and the heat sinks 82 outside the FPC boards 50. Sealing members 84 are provided for bonding between the top surfaces of the heat sinks 82 and the substrates 81 and between the bottom surfaces of the heat sinks 82 and the FPC boards 50, which prevents dust or ink from entering the main body of the ink-jet head 1.

Figure 3:
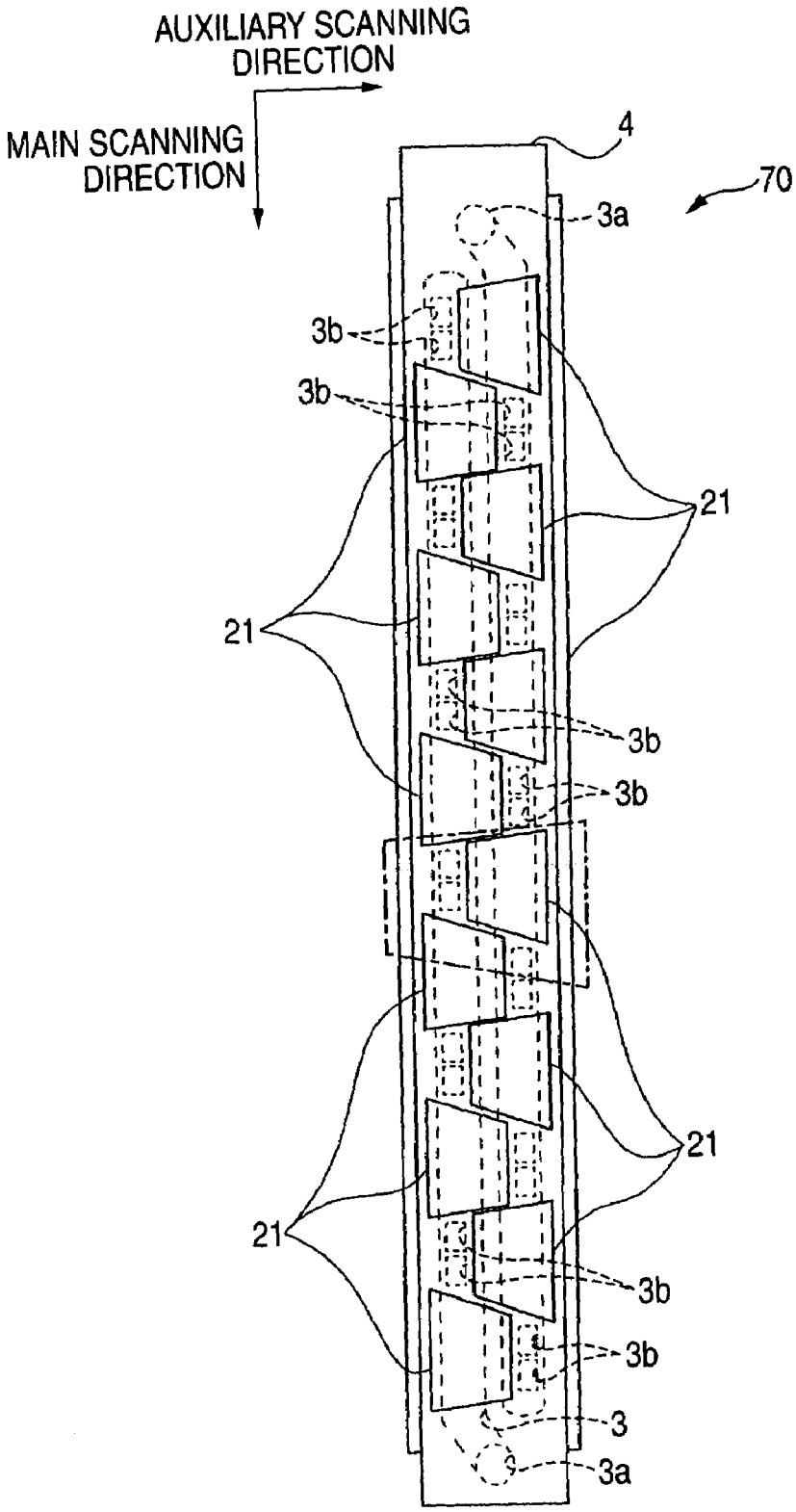
FIG. 3 is a plan view of a head main body shown in FIG.

FIG. 3 is a plan view of the head main body 70 shown in FIG. 1. In FIG. 3, the ink storages 3 which are formed in the base block 71 are drawn virtually by broken lines. The two ink storages 3 extend parallel with each other with a prescribed interval in the longitudinal direction of the head main body 70. Each of the two ink storages 3 has an opening (not shown) at one end and is supplied with ink through the opening from an ink tank (not shown) that is disposed outside, whereby each ink storage 3 is always filled with ink. Each ink storage 3 has many openings 3*b* that are arranged in the longitudinal direction of the head main body 70 and connect the ink storage 3 and the flow passage unit 4 as described above. The many openings 3*b* are arranged in pairs and the two openings 3*b* of each pair are arranged close to each other in the longitudinal direction of the head main body 70. The pairs of openings 3*b* that communicate with one ink storage 3 and the pairs of openings 3*b* that communicate with the other ink storage 3 are staggered.

The actuator units 21 that assume a trapezoid in a plan view are disposed in areas where the openings 3*b* are not disposed so as to be staggered in the opposite pattern to the pattern of the pairs of openings 3*b*. The parallel sides opposed to each other (i.e., top base and bottom base) of each actuator unit 21 are parallel with the longitudinal direction of the head main body 70. The oblique sides of adjoining actuator units 21 overlap with each other in the width direction of the head main body 70.

Figure 4:
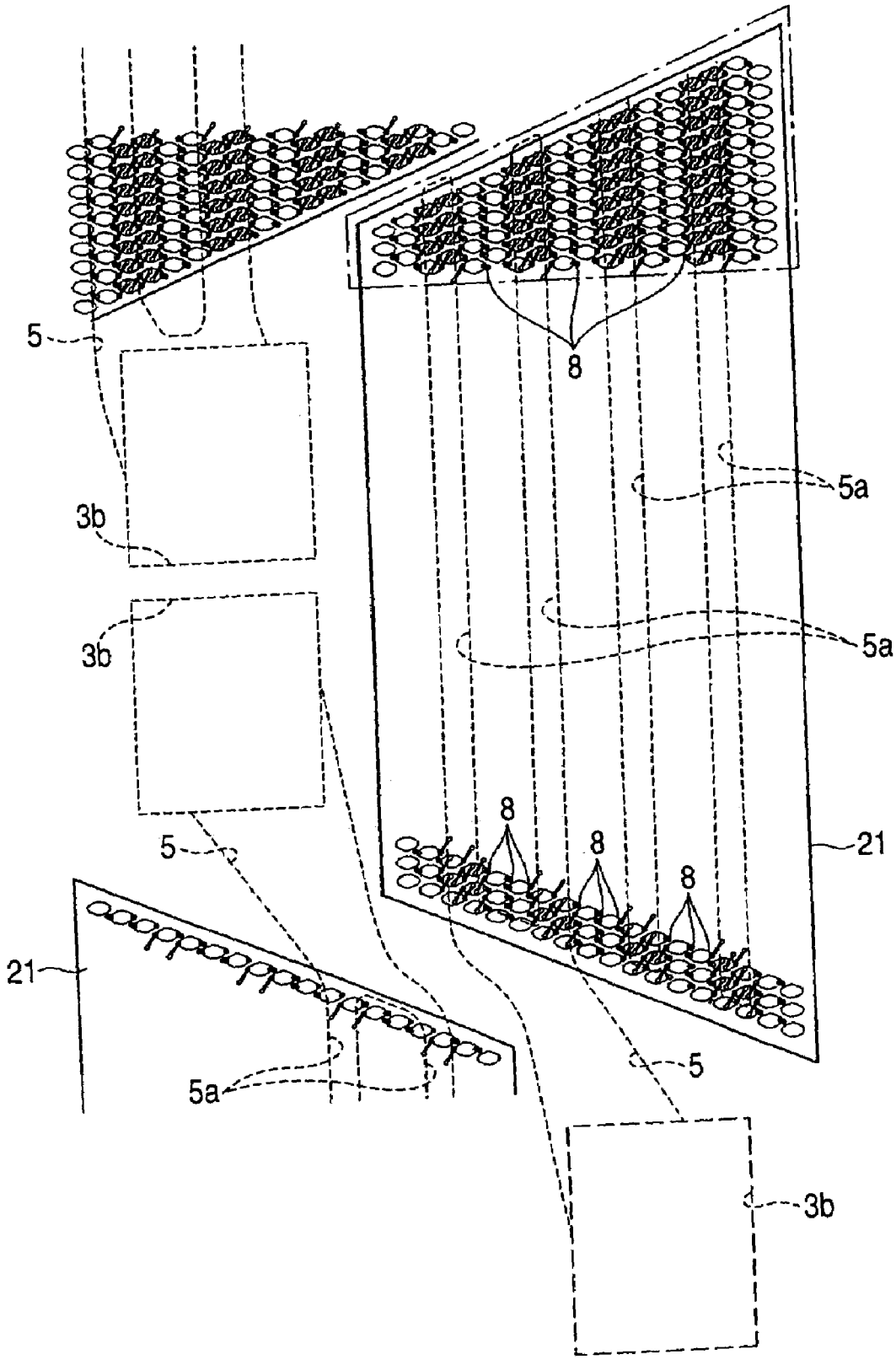
FIG. 4 is an enlarged view of an area that is enclosed by a chain line in FIG. 3.

FIG. 4 is an enlarged view of an area that is enclosed by a chain line in FIG. 3. As shown in FIG. 4, the openings 3*b* provided in each ink storage 3 communicate with respective manifold passages 5 as common ink rooms and each manifold passage branches at the tip into two sub-manifold passages 5*a*. In a plan view, two sub-manifold passages 5*a* that originate from each of the adjacent openings 3*b* go across each actuator unit 21 past one of its two oblique sides. That is, a total of four separated sub-manifold passages 5*a* extend under each actuator unit 21 along its parallel sides opposed to each other.

The portions of the bottom surface of the flow passage unit 4 that are opposed to the bonding areas of the actuator unit 21 are ink discharge areas, respectively. As described later, a large number of nozzles 8 are arranged in matrix form in each ink discharge area. Only part of the nozzles 8 are shown in FIG. 4 to simplify the drawing, but actually the nozzles 8 are arranged in the entire ink discharge area.

Figure 5:
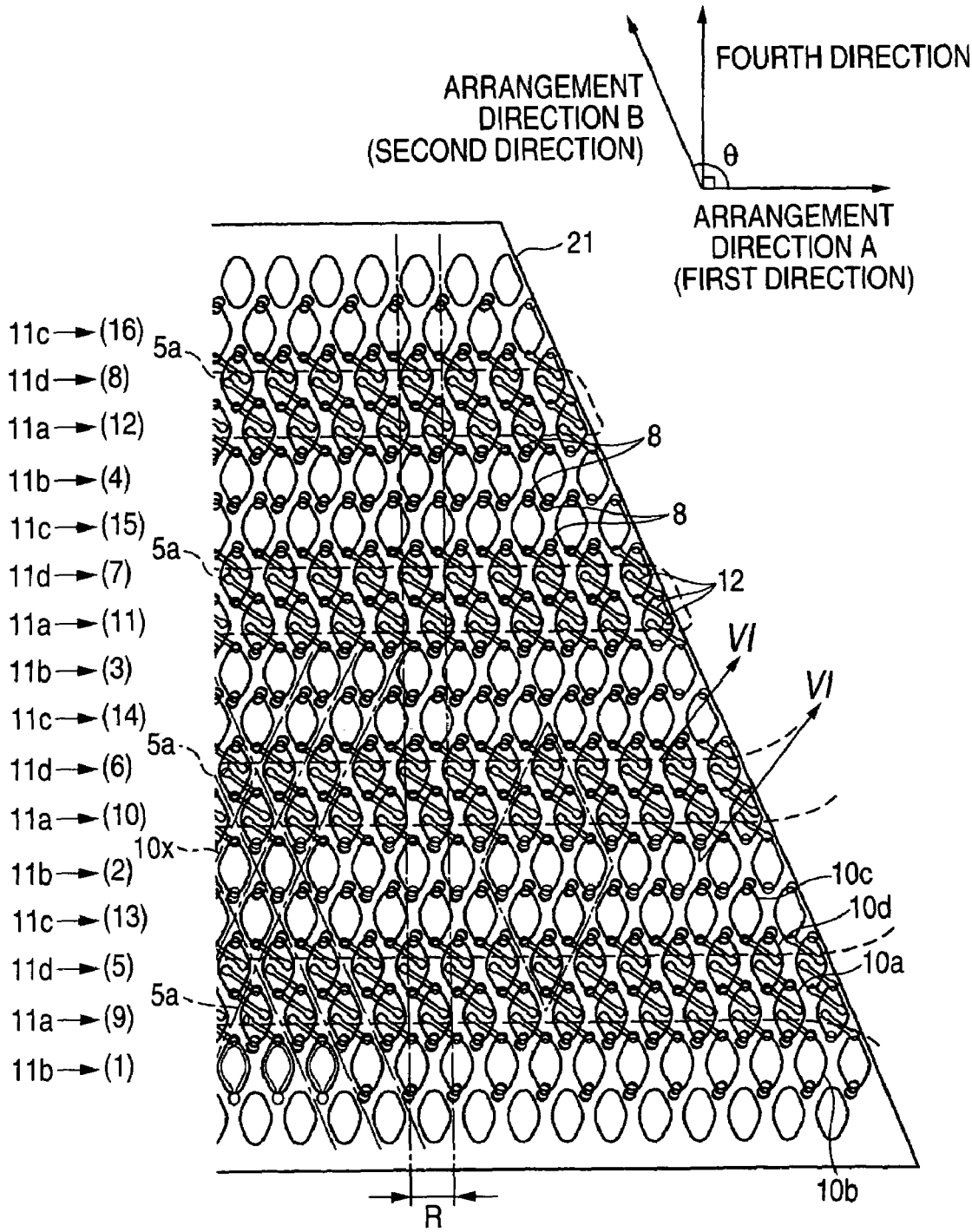
FIG. 5 is an enlarged view of an area that is enclosed by a chain line in FIG. 4.

FIG. 5 is an enlarged view of an area that is enclosed by a chain line in FIG. 4. FIGS. 4 and 5 show a plane, as viewed perpendicularly to the ink discharge surface, where many pressure chambers 10 of the flow passage unit 4 are arranged in matrix form. In a plan view, each pressure chamber 10 has a rhombus-like shape that has round corners and whose longer diagonal is parallel with the width direction of the flow passage unit 4. One end of each pressure chamber 10 communicates with a nozzle 8 and the other end communicates with a sub-manifold passage 5*a* as a common ink flow passage via an aperture 12 (see FIG. 6). To facilitate understanding of the drawings, the pressure chambers 10, the apertures 12, etc. that exist in the actuator unit(s) 21 or the flow passage unit 4 and hence should be drawn by broken lines are drawn by solid lines in FIGS. 4 and 5.

As shown in FIG. 5, virtual rhombic areas 10*x* that accommodate the respective pressure chambers 10 are arranged adjacent to each other in matrix form in an arrangement direction A (first direction) and an arrangement direction B (second direction) so as not to overlap with each other in such a manner that their sides share straight lines. The arrangement direction A is the longitudinal direction of the ink-jet head 1, that is, the extending direction of the sub-manifold passages 5*a*, and is parallel with the shorter diagonals of the rhombic areas 10*x*. The arrangement direction B is the direction of two set of oblique sides of the rhombic areas 10*x* and forms an obtuse angle θ with the arrangement direction A. Each pressure chamber 10 and the rhombic area 10*x* opposed to it share the center and have separated outlines in a plan view.

The pressure chambers 10, which are arranged adjacent to each other in matrix form in the two directions (arrangement directions A and B), are separated from each other in the arrangement direction A by a distance corresponding to 37.5 dpi. Eighteen pressure chambers 10 are arranged in the arrangement direction B in each ink discharge area. However, the pressure chambers 10 at the two ends in the arrangement direction B are dummies and do not contribute to ink droplet discharge.

The pressure chambers 10 that are arranged in matrix form form a plurality of pressure chamber lines extending in the arrangement direction A shown in FIG. 5. When viewed from the direction (third direction) perpendicular to the paper surface of FIG. 5, the pressure chamber lines are classified as first pressure chamber lines 11*a*, second pressure chamber lines 11*b*, third pressure chamber lines 11*c*, and fourth pressure chamber lines 11*d* according to the their relative positions with respect to the sub-manifold passages 5*a*. The first to fourth pressure chamber lines 11*a*-11*d* are arranged with a period of four lines in order of 11*c*→11*d*→11*a*→11*b*→11*c*→11*d*→. . . →11*b* from the top side to the bottom side of each actuator unit 21.

As for the pressure chambers 10*a* constituting the first pressure chamber lines 11*a* and the pressure chambers 10*b* constituting the second pressure chamber lines 11*b*, the nozzles 8 are located under (in the paper surface of FIG. 5) the associated sub-manifold passages 5*a* in the direction (fourth direction) perpendicular to the arrangement direction A when viewed from the third direction. And the nozzles 8 are located at the bottom ends of the associated rhombic areas 10*x*, respectively. On the other hand, as for the pressure chambers 10*c* constituting the third pressure chamber lines 11*c* and the pressure chambers 10*d* constituting the fourth pressure chamber lines 11*d*, the nozzles 8 are located under (in the paper surface of FIG. 5) the associated sub-manifold passages 5*a* in the fourth direction. And the nozzles 8 are located at the top ends of the associated rhombic areas 10*x*, respectively. More than half of each of the pressure chambers 10*a* and 10*d* constituting the first and fourth pressure chamber lines 11*a* and 11*d* coextends with the associated sub-manifold passage 5*a* when viewed from the third direction. The pressure chambers 10*b* and 10*c* constituting the second and third pressure chamber lines 11*b* and 11*c* do not overlap with the sub-manifold passages 5*a* at all when viewed from the third direction. Therefore, ink can be supplied to each pressure chamber 10 smoothly by maximizing the width of the sub-manifold passages 5*a* while preventing the nozzles 8 communicating with the pressure chambers 10 belonging to any pressure chamber line from existing in the area of a sub-manifold passage 5*a*.

Figure 6:
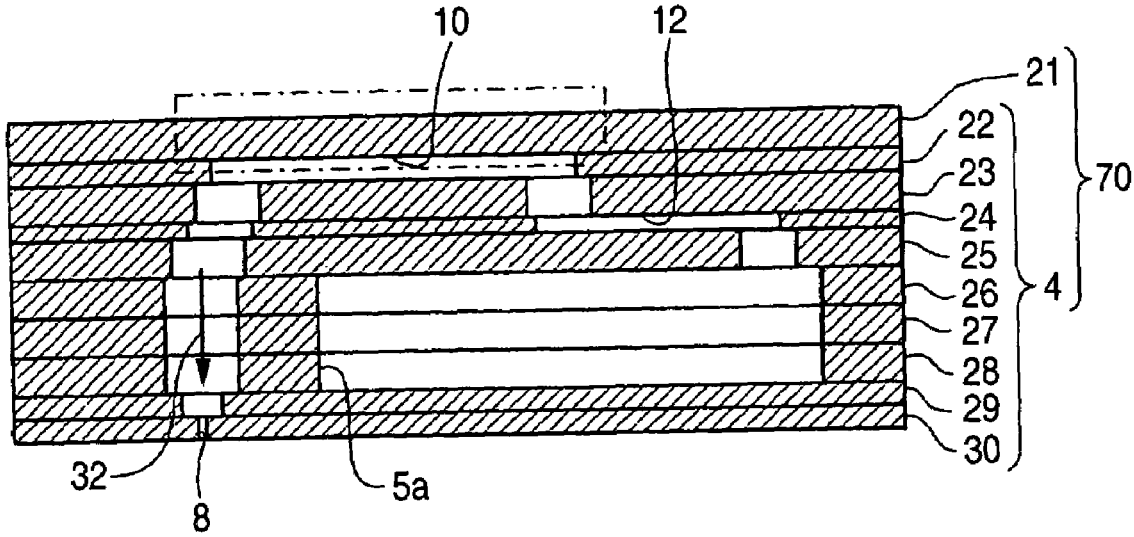
FIG. 6 is a sectional view taken along line VI-VI in FIG. 5.
Figure 7:
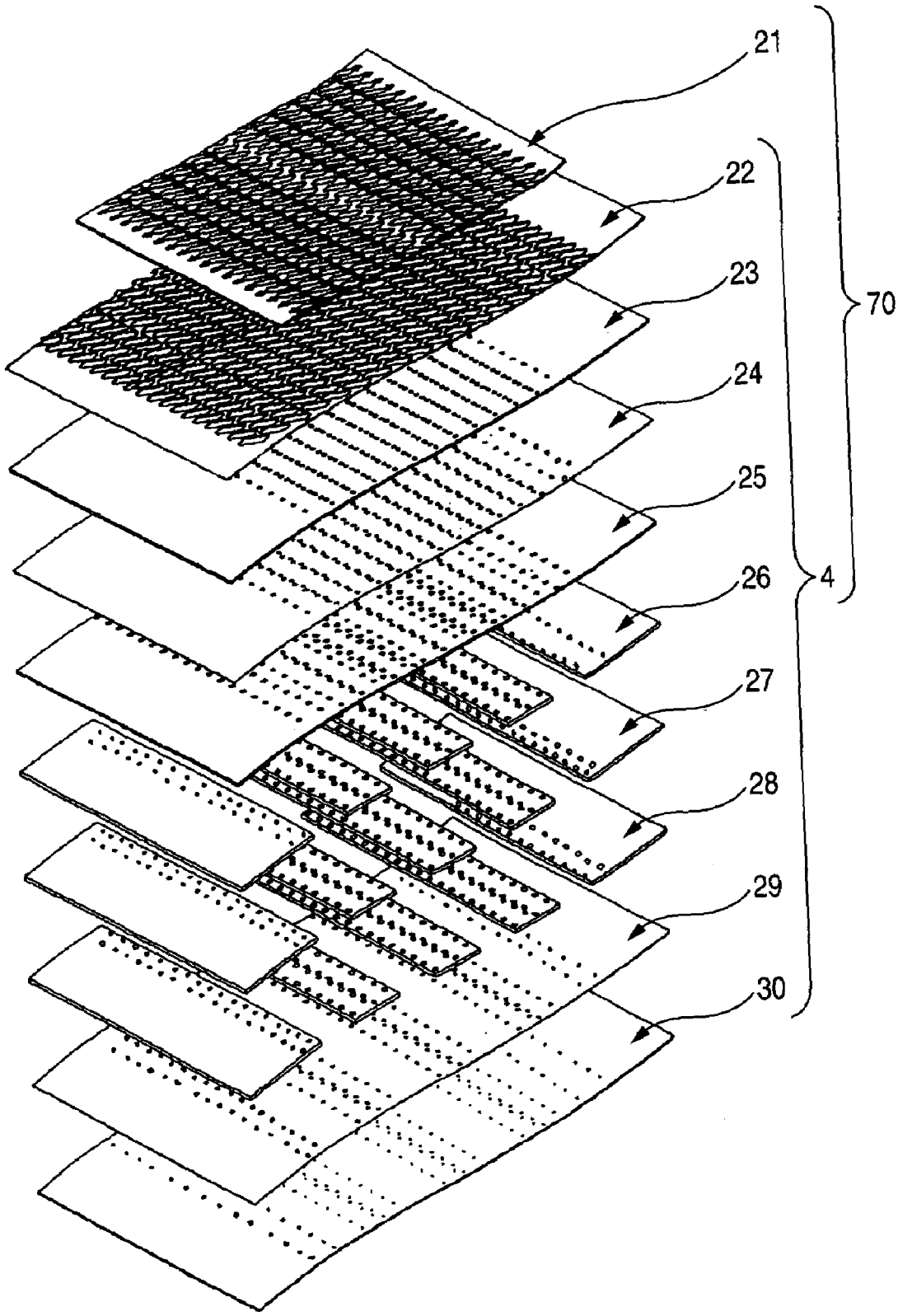
FIG. 7 is a partial exploded perspective view of the head main body shown in FIG. 5.

Next, the sectional structure of the head main body 70 will further be described with reference to FIGS. 6 and 7. FIG. 6 is a sectional view, taken along line VI-VI in FIG. 5, showing a pressure chamber 10*a* that belongs to a first pressure chamber line 11*a*. FIG. 7 is a partial exploded perspective view of the head main body 70. As seen from FIG. 6, the nozzle 8 communicates with the sub-manifold passage 5*a* via the pressure chamber 10 (10*a*) and the aperture 12. In this manner, an individual ink flow passage 32 that starts from the exit of the sub-manifold passage 5*a*, passes the aperture 12 and the pressure chamber 10, and reaches the nozzle 8 is formed in the head main body 70 for each pressure chamber 10.

As seen from FIG. 7, the head main body 70 has a lamination structure consisting of 10 sheet members that are, in order from the top, the actuator units 21, a cavity plate 22, a base plate 23, an aperture plate 24, a supply plate 25, manifold plates 26, 27, and 28, a cover plate 29, and a nozzle plate 30. The flow passage unit 4 consists of the nine metal plates excluding the actuator units 21 among the above sheet members.

As described later in detail, each actuator unit 21 is a lamination of four piezoelectric sheets 41-44 (see FIG. 8). Only the uppermost layer of them is given electrodes and has a portion that becomes an active layer when an electric field is applied to it (this layer will be referred to simply as "layer having an active layer"), and the other three layers are inactive layers. The cavity plate 22 is a metal plate that is formed with a large number of generally rhombic openings of the respective pressure chambers 10. The base plate 23 is a metal plate that is formed with, for each pressure chamber 10 of the cavity plate 22, a communication hole connecting the pressure chamber 10 and the aperture 12 and a communication hole for communication between the pressure chamber 10 and the ink nozzle 8. The aperture plate 24 is a metal plate that is formed with, for each pressure chamber 10 of the cavity plate 22, two holes, the aperture 12 (etching region) that connects the two holes, and a communication hole for communication between the pressure chamber 10 and the ink nozzle 8. The supply plate 25 is a metal plate that is formed with, for each pressure chamber 10 of the cavity plate 22, a communication hole connecting the aperture 12 and the sub-manifold passage 5*a* and a communication hole for communication between the pressure chamber 10 and the ink nozzle 8. The manifold plates 26, 27, and 28 are metal plates that are formed with holes that are connected to each other to form the sub-manifold passages 5*a* when they are laminated together, and are also formed with, for each pressure chamber 10 of the cavity plate 22, respective communication holes for communication between the pressure chamber 10 and the ink nozzle 8. The cover plate 29 is a metal plate that is formed with, for each pressure chamber 10 of the cavity plate 22, a communication hole for communication between the pressure chamber 10 and the ink nozzle 8. The nozzle plate 30 is a metal plate that is formed with the ink nozzle 8 for each pressure chamber 10 of the cavity plate 22.

The above nine metal plates are laminated together after being positioned with respect to each other so as to form the individual ink flow passages 32 shown in FIG. 6. Each individual ink flow passage 32 goes upward from the associated sub-manifold passage 5*a*, runs horizontally in the aperture 12, goes upward further, runs horizontally again in the pressure chamber 10, goes obliquely downward away from the aperture 12, and finally goes downward toward the nozzle 8.

Next, a description will be made of the structure of the laminated actuator units 21 that are laid on the cavity plate 22 of the flow passage unit 4. FIG. 8 is partial enlarged views of one of the actuator units 21 shown in FIG. 4: FIG. 8(*a*) is an enlarged plan view of part of the top surface of the actuator unit 21 and FIG. 8(*b*) is a partial sectional view taken along line X-X in FIG. 8(*a*).

Figure 8A:
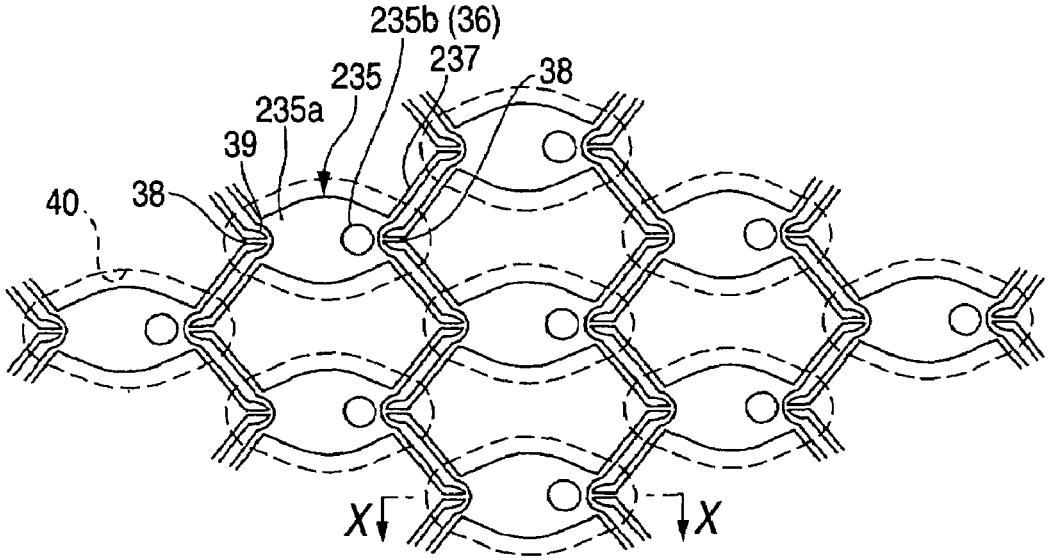
FIG. 8A is an enlarged plan view of part of the top surface of the actuator unit of the ink-jet head according to the first embodiment of the invention.
Figure 8B:
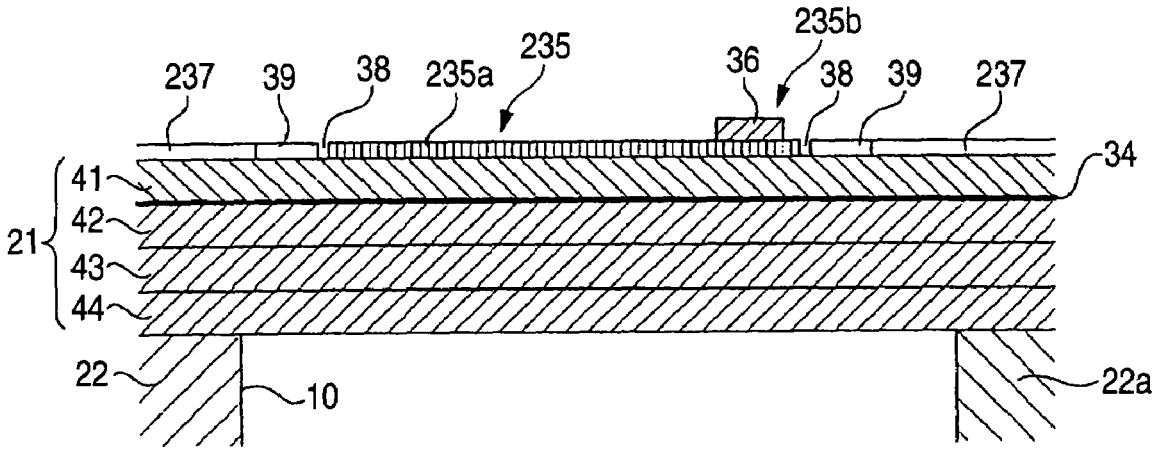
FIG. 8B is a partial sectional view taken along line X-X in FIG. 8A.

As shown in FIG. 8(*b*), each actuator unit 21 is a laminated structural body mainly consisting of four piezoelectric sheets 41-44. Each layer is a continuous flat plate having a thickness of about 15 μm. The actuator unit 21 covers a plurality of pressure chambers 10. The piezoelectric sheets 41-44 are made of a lead zirconate titanate (PZT)-type ceramic material that exhibits ferroelectricity.

Individual electrodes 235 are formed on the uppermost piezoelectric sheet 41 so as to be opposed to the respective pressure chambers 10. A common electrode 34 is interposed between the uppermost piezoelectric sheet 41 and the piezoelectric sheet 42 that is located immediately under the former in the lamination direction so as to stretch over the entire sheet area. The individual electrodes 235 and the common electrode 34 are made of a metal material of an Ag—Pd type, for example. The individual electrodes 235 and the common electrode 34 are about 1 μm and about 2 μm in thickness, respectively.

Since as described above the piezoelectric sheets 41-44 are formed as continuous flat plates and cover a plurality of pressure chambers 10, the individual electrodes 235 can be formed on the piezoelectric sheet 41 at a high density by screen printing, for example.

In this embodiment, as shown in FIG. 8(*a*), the individual electrodes 235 are arranged so as to correspond to the respective pressure chambers 10 that are arranged in matrix form. In FIG. 8(*a*), the area occupied by each pressure chamber 10 in the top surface of the cavity plate 22 is projected onto the plane of the actuator unit 21 and drawn by a broken line as a pressure chamber area 40 of the actuator unit 21. Each pressure chamber 10 has an approximately rhombic outline shape. Each individual electrode 235 has a main electrode region 235*a* that is formed inside the associated pressure chamber area 40, a connection electrode region 235*b* that is a land 36 that is formed inside the area of the main electrode region 235*a* and is to be bonded to a terminal of the FPC board 50, and auxiliary electrode portions 237 that extend from the main electrode region 235*a* to adjacent individual electrodes 235.

The main electrode region 235*a* of each individual electrode 235 is approximately similar to the pressure chambers 10 in a plan view and has an approximately rhombic outline shape. As shown in FIG. 8(*a*), the main electrode region 235*a* has cuts at two acute angle portions corresponding to the acute-angled apices of the rhombic shape. To conform to the above cuts, two acute angle portions of the associated pressure chamber area 40 are made main-electrode-lacking regions 38 that lack the main electrode region 235*a*. Four single auxiliary electrode portions 237 extend almost straightly from the portions, close to the cuts, of the main electrode region 235*a* toward the four respective pressure chambers 10 that are adjacent to the pressure chamber 10 associated with the main electrode region 235*a*.

In other words, four single auxiliary electrode portions 237 extend almost straightly from the main electrode regions 235*a* corresponding to the four adjacent pressure chambers 10 to the main-electrode-lacking regions 38. That is, in each main-electrode-lacking region 38, the two auxiliary electrode portions 237 extending from outside the pressure chamber area 40, the two auxiliary electrode portions 237 extending outward from the pressure chamber area 40, and the main electrode region 235*a* adjoin each other and are opposed to the acute angle portion of the associated pressure chamber 10. Among the above electrode portions and region, the tip portions of the two auxiliary electrode portions 237 extending from outside are proximate portions 39 that serve to suppress structural crosstalk (described later). The proximate portions 39 of the two auxiliary electrode portions 237 extending from outside and the main electrode region 235*a* are electrically insulated from each other and drive voltages can be applied to them individually.

As described above, in this embodiment, not only the main electrode region 235*a* that contributes to the ink droplet discharge by varying the capacity of the pressure chamber 10 but also the two proximate portions 39 that are electrically connected to the individual electrodes 235 provided in the adjacent pressure chamber areas 40 are provided in each pressure chamber area 40. This embodiment is also characterized in that the two auxiliary electrode portions 237 extend to suppress structural crosstalk that is transmitted by a capacity variation of the pressure chamber 10 concerned.

Figure 9:
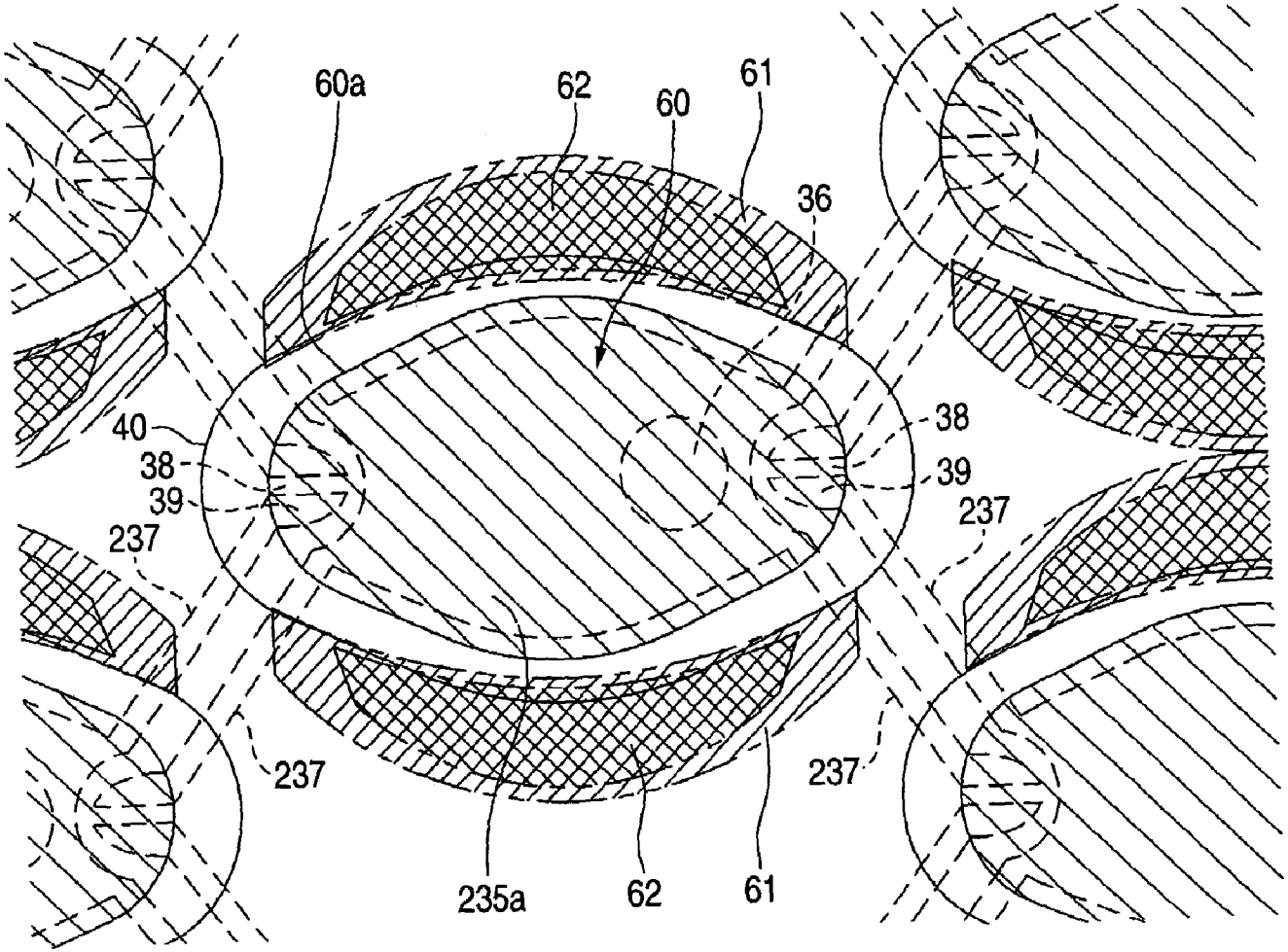
FIG. 9 shows areas that influence the capacity variation of each pressure chamber in such a manner that the areas are discriminated from each other in terms of the manner and degree of influence on the ink droplet discharge in the ink-jet head according to the first embodiment of the invention.

FIG. 9 shows areas that influence the capacity variation of each pressure chamber 10 in such a manner that the areas are discriminated from each other in terms of the manner and degree of influence on the ink droplet discharge. In FIG. 9, pressure chamber areas 40 of an actuator unit 21 are drawn by solid lines. As shown in FIG. 9, a reference line 60*a* is drawn to indicate particular positions in each pressure chamber area 40. The reference line 60*a* indicates such positions that even if an electrode exists on the reference line 60*a* and a drive voltage is applied to it, no capacity variation occurs at all in the pressure chamber 10. Even if an electrode exists on the reference line 60*a*, the electrode does not have a function of discharging an ink droplet. The reference line 60*a* encloses a generally rhombic area that is approximately similar to the pressure chamber 10. The area enclosed by the reference line 60*a* is a functional area 60 that functions to contribute to the ink droplet discharge by varying the capacity of the pressure chamber 10 if it is assumed that an electrode exists there and a drive voltage is applied to it. In the functional area 60, the degree of contribution to the ink droplet discharge increases as the position comes closer to the center. That is, the functional area 60 is an area that positively influences the driving of the pressure chamber 10 corresponding to the individual electrode 235.

On the other hand, the area outside the reference line 60*a* varies the capacity of the pressure chamber 10 but functions to obstruct desired ink droplet discharge if it is assumed that an electrode exists there and a drive voltage is applied to it. In this embodiment, as shown in FIG. 9, obstructive areas 61 that function to obstruct the desired ink droplet discharge to a non-negligible degree are formed adjacent to the two obtuse angle portions of the pressure chamber area 40, respectively. The obstructive areas 61 extend along the outer periphery of the pressure chamber area 40 from the portions close to the two obtuse angle portions of the pressure chamber area 40 to positions close to the two acute angle portions. Areas 62 are parts of the obstructive areas 61 that function to obstruct the desired ink droplet discharge particularly strongly. The outline shapes of the areas 62 are approximately similar to those of the obstructive areas 61. The obstructive areas 61 and the areas 62 are areas that negatively influence the driving of the pressure chamber 10 corresponding to the individual electrode 235. FIG. 9 explicitly shows the areas (e.g., obstructive areas 61 and areas 62) that negatively influence the ink droplet discharge at least to a non-negligible degree. However, the area outside the reference line 60*a* negatively influences the ink droplet discharge though the degree of influence depends on the position.

As indicated by a broken line in FIG. 9, the main electrode region 235*a* is disposed so as to be contained in the functional area 60. The two auxiliary electrode portions 237 that extend from the main electrode region 235*a* are disposed so as to minimize the overlaps with the obstructive areas 61, respectively. In this embodiment, although coextending with the obstructive area 61 in part of the main-electrode-lacking region 38 and its vicinity, each auxiliary electrode portion 237 extends almost straightly so as to avoid the obstructive areas 61 corresponding to the another pressure chamber areas 40. Further, the proximate portions 39 of the auxiliary electrode portions 237 extending almost straightly from the another pressure chamber areas 40 are provided in the two main-electrode-lacking regions 38 of the pressure chamber area 40.

Incidentally, the common electrode 34 is grounded in a non-illustrated region, whereby the common electrode 34 is kept at the ground potential in the regions opposed to all the pressure chambers 10. The FPC board 50 (see FIGS. 1 and 2) that is electrically connected to the driver IC 80 is connected to the lands 36 of the connection electrode regions 235*b* of the individual electrodes 235, whereby the potentials of the individual electrodes 235 can be controlled individually for the respective pressure chambers 10. In this embodiment, the lands 36 have a diameter of about 160 μm and are made of, for example, gold containing glass frit. Each land 36 is formed on the main electrode region 235*a* at a position close to one main-electrode-lacking region 38 of the pressure chamber area 40. Connection terminals of the FPC board 50 are connected to the lands 36 of the individual electrodes 235 by ordinary solder bonding or using a conductive adhesive. However, the efficiency of deformation occurring when a drive voltage is applied is not thereby lowered because the land 36 is formed at the position that is distant from the central portion of the pressure chamber area 40 that contributes most greatly to the capacity variation of the pressure chamber 10.

Next, a driving method of the actuator units 21 will be described. The polarization direction of the piezoelectric sheet 41 of each actuator unit 21 is in its thickness direction. That is, the actuator units 21 has what is called the unimorph structure in which the single upper (i.e., distant from the pressure chamber 10) piezoelectric sheet 41 serves as a layer having an active portion (referred to as an active layer) and the three lower (i.e., close to the pressure chamber 10) piezoelectric sheets 42-44 are inactive layers (reffered to as inactive portions) respectively. Therefore, when an individual electrode 235 is given a positive or negative prescribed potential, if, for example, the electric field is in the same direction as the polarization, the electric field application portion of the piezoelectric sheet 41 that is interposed between the electrodes acts as an active layer and contracts perpendicularly to the polarization direction according to the piezoelectric lateral effect. On the other hand, the piezoelectric sheets 42-44 themselves do not contract because they are not affected by the electric field. As a result, a strain difference occurs in the direction perpendicular to the polarization direction between the upper piezoelectric sheet 41 and the lower piezoelectric sheets 42-44, and hence the piezoelectric sheets 41-44 are forced to be deformed as a whole so as to become convex toward the inactive side (unimorph deformation). Since as shown in FIG. 8 the bottom surface of the piezoelectric sheets 41-44 is fixed to the top surface of the cavity plate 22 that defines the pressure chamber 10, the piezoelectric sheets 41-44 are deformed so as to become convex toward the pressure chamber 10. The capacity of the pressure chamber 10 is decreased, the ink pressure is increased, and an ink droplet is discharged from the nozzle 8. Then, when the potential of the individual electrode 235 is returned to the same potential as the potential of the common electrode 34, the shape of the piezoelectric sheets 41-44 returns to the original shape. The pressure chamber 10 recovers its original capacity and hence sucks ink from the manifold passage 5 side.

Another driving method is as follows. The potential of the individual electrode 235 is set different from the potential of the common electrode 34 in advance. The individual electrode 235 is temporarily given the same potential as the common electrode 34 each time a discharge request occurs. Then, with prescribed timing, the potential of the individual electrode 235 is returned to the potential different from the potential of the common electrode 34. In this case, the shape of the piezoelectric sheets 41-44 returns to the original shape with the timing that the potential of the individual electrode 235 becomes the same as the potential of the common electrode 34, whereby the capacity of the pressure chamber 10 becomes larger than in the initial state (the two electrodes have the different potentials) and ink is sucked into the pressure chamber 10 from the manifold passage 5 side. Then, with timing that the potential of the individual electrode 235 is again made different from that of the common electrode 34, the piezoelectric sheets 41-44 are deformed so as to become convex toward the pressure chamber 10. The capacity of the pressure chamber 10 is decreased, the pressure acting on the ink is increased, and an ink droplet is discharged.

If the direction of an electric field applied to the piezoelectric sheet 41 is opposite to its polarization direction, the active layer of the piezoelectric sheet 41 that is interposed between the individual electrode 235 and the common electrode 34 is forced to expand in the direction perpendicular to the polarization direction according to the piezoelectric lateral effect. Therefore, the piezoelectric sheets 41-44 are deformed so as to become convex toward the pressure chamber 10. As a result, the capacity of the pressure chamber 10 is increased and the pressure chamber 10 sucks ink from the manifold passage 5 side. When the potential of the individual electrode 235 is thereafter returned to the original potential, the piezoelectric sheets 41-44 recover their original flat plate shapes. The capacity of the pressure chamber 10 returns to the original value, and hence an ink droplet is discharged from the nozzle 8.

As described above, in the ink-jet head 1 according to this embodiment, most of the individual electrode 235 including the connection electrode region 235*b* is opposed to the pressure chamber 10. As described above, in each portion of each actuator unit 21 that is opposed to the associated pressure chamber 10 (i.e., each portion of each actuator unit 21 that corresponds to the associated pressure chamber area 40), only the uppermost piezoelectric sheet 41 among the piezoelectric sheets 41-44 is interposed between the individual electrode 235 and the common electrode 34. The interposed portion becomes an active layer. When a drive voltage is applied to the individual electrode 235, the active layer right under the individual electrode 235 is deformed. If the direction of an electric field generated by the drive voltage is the same as the polarization direction of the piezoelectric sheet 41, the active layer is forced to not only expand in the polarization direction but also contract perpendicularly to the polarization direction according to the piezoelectric effect. Since the portion around the pressure chamber area 40 of the actuator unit 21 is fixed to the top surface of the portion of a partition 22*a* that defines the pressure chamber 10, such a displacement of the active layer acts on the pressure chamber 10 so as to decrease its capacity (unimorph deformation) and contributes to ink droplet discharge.

The deformation of the active layer of the pressure chamber area 40 influences the surrounding portion of the piezoelectric sheets 41-44. If the portion of the piezoelectric sheet 41 in the pressure chamber area 40 is contracted (deformed), the surrounding portion of the piezoelectric sheets 41-44 is expanded. The displacement in the direction of decreasing the capacity of the pressure chamber 10 concerned that is caused by the deformation of the active layer causes the actuator unit 21 to be displaced in the direction of increasing the capacities of the pressure chambers 10 corresponding to another pressure chamber areas 40 with fixed top surface portions of the partition 22*a* serving as supporting points. This influence of the deformation of the active layer on the surrounding portion obstructs displacements for discharging ink droplets of another pressure chamber areas 40 in a range that is influenced by the deformation.

In this embodiment, the deformation influences the surrounding portion of the pressure chamber 10 relatively isotropic manner because of the form of arrangement of the pressure chambers 10 and the shape of the individual electrodes 235. However, the deformation most influences the four adjacent pressure chambers 10 whose oblique sides are opposed to the respective oblique sides of the pressure chamber 10 concerned (the pressure chambers 10 have an approximately rhombic shape). However, in each actuator unit 21 of the embodiment, the auxiliary electrode portions 237 extend from the acute angle portions of each main electrode region 235*a* toward the other pressure chambers 10 and the proximate portions 39 of the auxiliary electrode portions 237 are located in the main-electrode-lacking portions 38 of the adjacent pressure chambers 10. Therefore, when a drive voltage is applied to the individual electrode 235, it is also applied to the proximate portions 39 that are located in the main-electrode-lacking portions 38 of the adjacent pressure chambers 10. The proximate portions 39 act in the same manner as the main electrode region 235*a*, whereby the capacities of the another adjacent pressure chambers 10 corresponding to the proximate portions 39 are varied in the same direction as the capacity of the another adjacent pressure chamber 10 corresponding to the main electrode region 235*a*. As a result, when a drive voltage is applied, displacements of the another adjacent pressure chambers 10 that are induced at the same time and obstruct the ink droplet discharge, that is, displacements in the direction of increasing the capacities of the another adjacent pressure chambers 10 are canceled out by displacements that are induced by the proximate portions 39 located in the another adjacent pressure chambers 10 and are in the direction of decreasing the capacities of the adjacent pressure chambers 10. Therefore, the structural crosstalk can be suppressed even if the pressure chambers 10 are arranged at a high density.

The amount of variation, caused by the proximate portions 39, of the capacity of the pressure chamber 10 has some correlation with the area of the proximate portions 39. Therefore, it is ideal that the area of the proximate portions 39 be such as to be able to just cancel out structural crosstalk that is induced when a drive voltage is applied. However, from the viewpoint of the uniformization of the ink discharge characteristic, the area of the proximate portions 39 may be such as to be able to partially cancel out the structural crosstalk. On the other hand, if the area of the proximate portions 39 is too wide to just cancel out the structural crosstalk, an undue increase in power consumption is caused. Too wide an area of the proximate portions 39 has a negative influence on the operation for attaining desired ink droplet discharge. On balance, what is appropriate is to determine the area of the proximate portions 39 so that their effect is at a level capable of just canceling out structural crosstalk to be induced or lower. In this embodiment, each of the auxiliary electrode portions 237 extends to the associated adjacent pressure chamber area 40 while overlapping with part of the obstructive area 61 that is close to the acute angle portion of the pressure chamber area 40 concerned. Therefore, the area of the proximate portions 39 may be determined by taking into consideration the magnitude of structural crosstalk to be induced by the auxiliary electrode portions 237 themselves. In either case, the structural crosstalk can be suppressed in a well-balanced manner without inputting unduly high power in driving.

In this embodiment, each auxiliary electrode portion 237 extends almost straightly so as to minimize the overlap with the obstructive areas 61 that are associated with the pressure chamber area 40 to which the auxiliary electrode portion 237 belongs to and the adjacent pressure chamber areas 40. Therefore, the auxiliary electrode portions 237 are relatively short and occupy small areas. This further lowers the power that is consumed at the time of application of drive voltages, and hence makes it possible to suppress the structural crosstalk effectively.

Figure 10A:
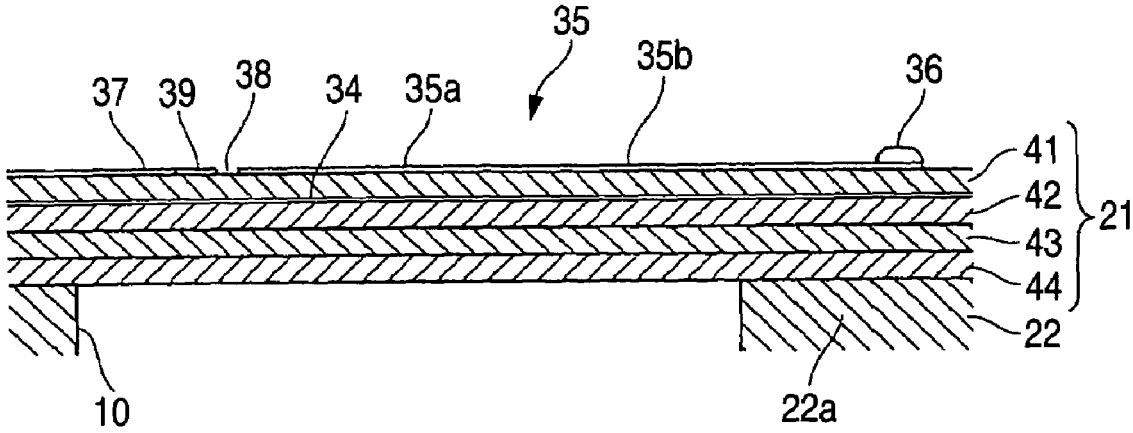
FIG. 10A is an enlarged sectional view of a portion that is enclosed by a chain line in FIG. 6 according to a second embodiment of the invention.
Figure 10B:
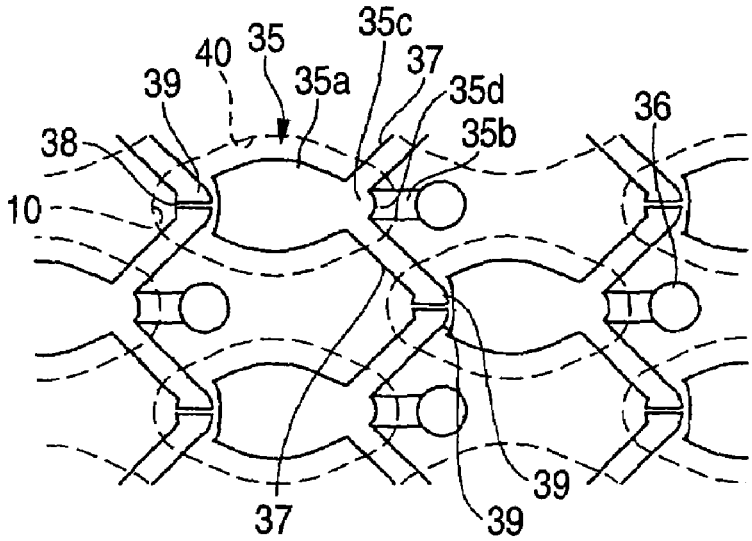
FIG. 10B is an enlarged plan view of part of the top surface of the actuator unit.

Next, an ink-jet head according to a second embodiment of the invention will be described. FIG. 10 is partial enlarged views of each actuator unit 21 of the ink-jet head according to the second embodiment of the invention; FIG. 10(*a*) is an enlarged sectional view of a portion that is enclosed by a chain line in FIG. 6 and FIG. 10(*b*) is an enlarged plan view of part of the top surface of the actuator unit 21. The ink-jet head according to the second embodiment is different from the ink-jet head 1 according to the first embodiment only in the shapes of portions of each individual electrode (235). Therefore, the other components will be given the same reference symbols as in the first embodiment and will not be described in detail.

As shown in FIG. 10(*a*), the ink-jet head according to the second embodiment is equipped with actuator units 21 each of which mainly consists of four piezoelectric sheets 41-44 having the same thickness of about 15 μm. The second embodiment is the same as the first embodiment also in that the piezoelectric sheets 41-44 take a form of a lamination of continuous flat plates so as to cover a large number of pressure chambers 10.

The second embodiment is the same as the first embodiment also in that as shown in FIG. 10(*b*) individual electrodes 35 are arranged adjacent to each other so as to correspond to the respective pressure chambers 10 that are arranged in matrix form. Each individual electrode 35 has a main electrode region 35*a* that is formed inside the pressure chamber area 40, a connection electrode region 35*b* that extends from one acute angle portion of the main electrode region 35*a*, and auxiliary electrode portions 37 that extend from the same acute angle portion to outside the pressure chamber area 40. A circular land 36 is formed at the tip of the connection electrode region 35*b*. A drive voltage is applied to the individual electrode 35 via the FPC board 50 that is connected to the land 36.

The main electrode region 35*a* of each individual electrode 35 is approximately similar to the pressure chambers 10 in a plan view and has a generally rhombic outline shape. As shown in FIG. 10(*b*), the main electrode region 35*a* has a cut at one acute angle portion (the left-hand acute angle portion in FIG. 10(*b*)). To conform to the above cut, the left-hand acute angle portion of the associated pressure chamber area 40 is made a main-electrode-lacking region 38 that lacks the main electrode region 35*a*. Two single auxiliary electrode portions 37 extend almost straightly to the main-electrode-lacking region 38 from the main electrode regions 35*a* corresponding to two other pressure chambers 10, respectively, that are adjacent to the pressure chamber 10 associated with the main electrode region 35*a* concerned. That is, in the main-electrode-lacking region 38, the two auxiliary electrode portions 37 extending from outside the pressure chamber area 40 and the main electrode region 35*a* adjoin each other and are opposed to the acute angle portion of the associated pressure chamber 10. Among the above electrode portions and region, the tip portions of the two auxiliary electrode portions 37 are proximate portions 39 that serve to suppress structural crosstalk (described later). The proximate portions 39 of the two auxiliary electrode portions 37 extending from outside and the main electrode region 35*a* are electrically insulated from each other and drive voltages can be applied to them individually.

On the other hand, the connection electrode region 35*b* extends from the right-hand acute angle portion of the main electrode region 35*a* in the direction of the diagonal of the main electrode region 35*a* connecting its right-angled apices (i.e., rightward in FIG. 10(*b*)). The connection electrode region 35*b* is disposed between two other pressure chambers 10 that are adjacent to the pressure chamber 10 corresponding to the main electrode region 35*a*, and a circular land 36 having a diameter of about 160 μm is formed at the tip of the connection electrode region 35*b*. Therefore, the land 36 is located between the two main electrode regions 35*a* corresponding to the two adjacent pressure chambers 10. For application of a drive voltage, the land 36 is connected to a contact of the FPC board 50. As shown in FIG. 10(*a*), the land is disposed so as to be opposed to a portion of the partition 22*a* that is formed in the cavity plate 22 and defines the pressure chamber 10. Since the main electrode 35*a* and the connection electrode region 35*b* constitute a continuous electrode having a constant thickness, no boundary should be drawn in a drawing. However, a boundary 35*d* is drawn in FIG. 10(*b*) for the sake of convenience.

Further, to auxiliary electrode portions 37 extend almost straightly from proximate portions 35*c* that are in close proximity to the boundary 35*d* toward two other pressure chambers 10, respectively, that are adjacent to the pressure chamber 10 corresponding to the main electrode region 35*a*. The proximate portions 39 of these auxiliary electrode portions 37 are located in the main-electrode-lacking region 38 of the pressure chamber areas 40 corresponding to the two other pressure chambers 10, respectively.

As described above, in this embodiment, each pressure chamber area 40 has one main-electrode-lacking region 38 and is provided with not only the main electrode region 35*a* that contributes to the ink droplet discharge by varying the capacity of the another pressure chamber 10 but also the two proximate portions 39 that are electrically connected to the individual electrodes 235 corresponding to the adjacent pressure chamber areas 40. This embodiment is also characterized in that the two auxiliary electrode portions 37 that extend to suppress structural crosstalk that is transmitted by a capacity variation of the another pressure chamber 10 concerned and the connection electrode region 35*b* that extends for application of a drive voltage are provided outside the pressure chamber area 40.

Figure 11:
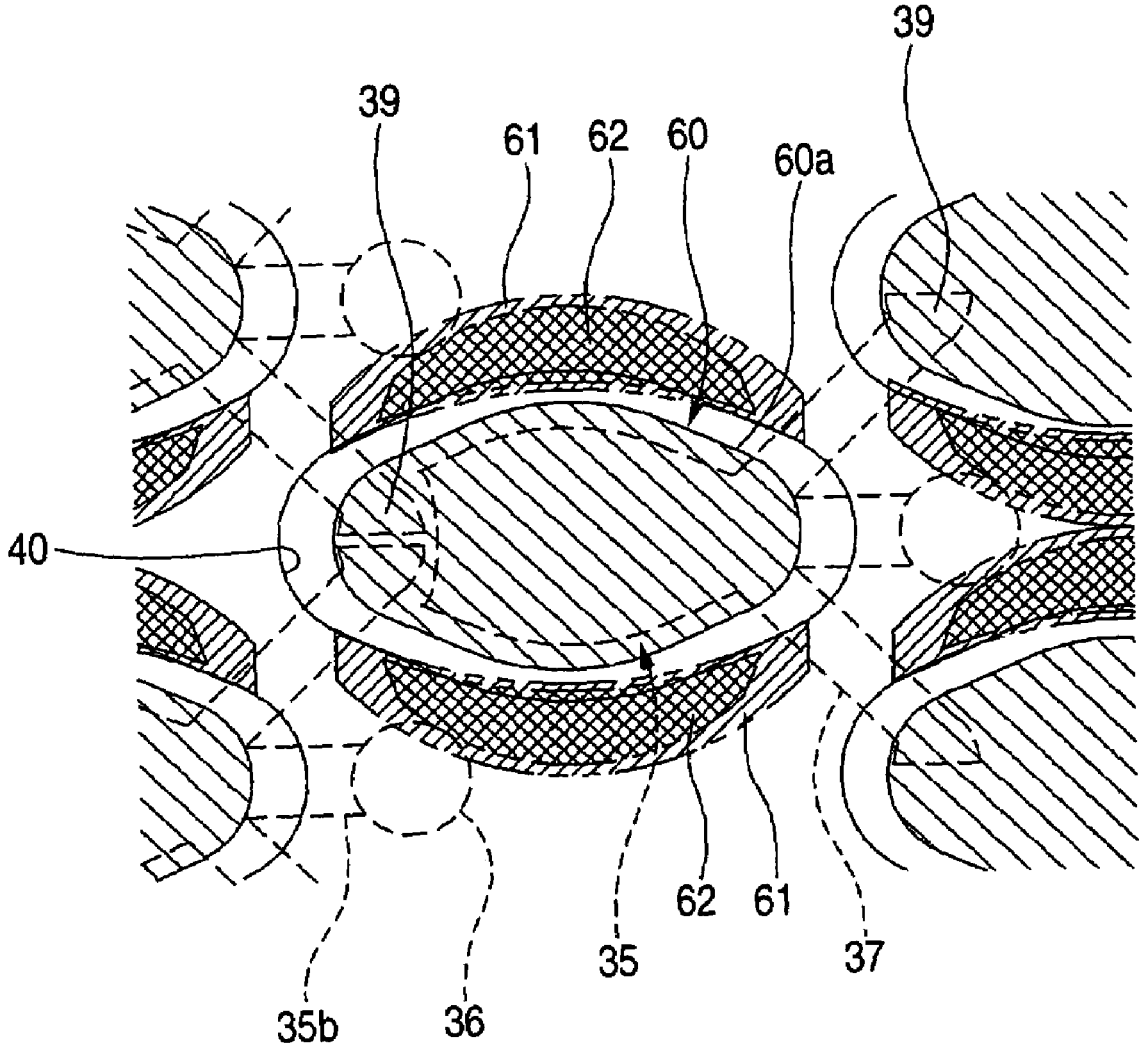
FIG. 11 shows areas that influence the capacity variation of each pressure chamber in such a manner that the areas are discriminated from each other in terms of the manner and degree of influence on the ink droplet discharge in the ink-jet head according to the second embodiment of the invention.

FIG. 11 shows areas that influence the capacity variation of each pressure chamber 10 in such a manner that the areas are discriminated from each other in terms of the manner and degree of influence on the ink droplet discharge. In FIG. 11, pressure chamber areas 40 of an actuator unit 21 are drawn by solid lines. As shown in FIG. 11, a particular area enclosed by a reference line 60*a* exists in each pressure chamber area 40. This area is a functional area 60 that positively contributes to the ink droplet discharge by varying the capacity of the pressure chamber 10 when a drive voltage is applied. On the other hand, obstructive areas 61 that negatively influence desired ink droplet discharge are formed outside the reference line 60*a*. Areas 62 are parts of the obstructive areas 61 that function to obstruct the desired ink droplet discharge more strongly.

The connection electrode region 35*b* that is connected to the acute angle portion of the pressure chamber area 40 extends between (is interposed between) two adjacent pressure chamber areas 40. The land is disposed at the tip of the connection electrode region 35*b*. The position of the land 36 is closer to the two adjacent pressure chamber areas 40 than the other portions of the individual electrode 35. Therefore, in this embodiment, whereas most of the connection electrode region 35*b* does not overlap with the obstructive areas 61, the land 36 overlaps with the obstructive areas 61 corresponding to the two adjacent pressure chamber areas 40. Right-hand tip portions (as viewed in FIG. 10(*b*)) of the land 36 coextend with parts of the obstructive areas 61, respectively. Further, although the two auxiliary electrode portions 37 that extend from the proximate portion 35*c* that is in close proximity to the boundary 35*d* coextend with parts of the obstructive areas 61 near the proximate portions 35*c*, respectively, they are formed so as to avoid the obstructive areas 61 corresponding to the two adjacent pressure chamber areas 40, respectively.

As described above, in this embodiment, in the one acute angle portion of each pressure chamber area 40, the connection electrode region 35*b* extends from the right-hand acute angle portion of the main electrode region 35*a* to above the portion of the partition 22*a* that separates the two adjacent pressure chambers 10. Further, the two auxiliary electrode portions 37 extend almost straightly to the adjacent pressure chamber areas 40, respectively, so as to be located on both sides of the thus-stretched connection electrode region 35*b*. The main-electrode-lacking region 38 is formed at the other acute angle portion of the pressure chamber area 40. The two single auxiliary electrode portions 37 extend almost straightly to the main-electrode-lacking region 38 from the another two adjacent pressure chamber areas 40, respectively, and the two proximate portions 39 as the tip portions of those auxiliary electrode portions 37 adjoin each other in the main-electrode-lacking region 38.

As described above, in the ink-jet head according to this embodiment, each actuator unit 21 that covers a plurality of pressure chambers 10 is fixed to the top surface of the partition 22*a* that defines the pressure chambers 10. In each actuator unit 21, only the uppermost piezoelectric sheet 41 is interposed between the common electrode 34 and the individual electrodes 35 and have active layers that are displaced themselves according to the piezoelectric effect. The lowermost piezoelectric sheet 44 as an inactive layer is fixed to the top surface of the partition 22*a*. Most of the land 36 and the connection electrode region 35*b* that are formed on the piezoelectric sheet 41 are opposed to the top surface of the partition 22*a*.

When a drive voltage is applied to an individual electrode 35, the active layer right under the main electrode region 35*a* is unimorph-deformed and decreases the capacity of the associated pressure chamber 10 and thus contributes to ink droplet discharge. The deformation, associated with the ink droplet discharge, of the active layer of the pressure chamber area 40 causes the portions of the piezoelectric sheets 41-44 around the pressure chamber area 40 to expand or to be deformed with top surface portions of the partition 22*a* serving as supporting points so as to obstruct the ink droplet discharge of the adjacent pressure chambers 10. The fact that such a negative influence on the ink droplet discharge is transmitted to the portion around the pressure chamber 10 in a relatively isotropic manner is the same as in the first embodiment.

The actuator units 21 of this embodiment are different from those of the first embodiment in that the connection electrode region 35*b* extends from the right-hand acute angle portion of each main electrode region 35*a* to outside the pressure chamber area 40 and that the land 36 is formed at the tip of the connection electrode region 35*b* so as to be closest to the adjacent pressure chamber areas 40. When a drive voltage is applied to an individual electrode 35, a displacement of the portion of the uppermost piezoelectric sheet 41 that corresponds to the land 36 and the connection electrode region 35*b* is transmitted to the two adjacent pressure chamber areas 40 on both sides of the land 36 and the connection electrode region 35*b*. At this time, if the portion of the piezoelectric sheet 41 that corresponds to the land 36 and the connection electrode region 35*b* is forced to contract parallel with the surface, the portions of the piezoelectric sheets 41-44 corresponding to the two adjacent pressure chamber areas 40 are expanded. The thus-induced displacements act so as to obstruct the ink droplet discharge of the adjacent pressure chambers 10. In this manner, in this embodiment, because of the peculiar shape of the individual electrode 35 that the land 36 that the connection electrode region 35*d* extends to outside the pressure chamber area 40, structural crosstalk is more prone to reach the two other pressure chamber areas 40 adjacent to the land 36 than in the first embodiment.

However, in this embodiment, the auxiliary electrode regions 37 extend from the main electrode region 35*a* of the individual electrode 35 and the proximate portions 39 of the auxiliary electrode portions 37 are disposed in the main-electrode-lacking regions 38 of the two adjacent pressure chamber areas 40, respectively. Because of this structure, when a drive voltage is applied to the main electrode region 35*a* of the individual electrode 35, it is also applied to the proximate portions 39 that are located in the main-electrode-lacking portions 38 of the adjacent pressure chambers 10. The proximate portions 39 act in the same manner as the main electrode region 35*a*, whereby the capacities of the pressure chambers 10 corresponding to the proximate portions 39 are varied in the same direction as the capacity of the pressure chamber 10 corresponding to the main electrode region 35*a*.

As a result, when a drive voltage is applied, induced displacements of the adjacent pressure chambers 10 that obstruct the ink droplet discharge are canceled out by opposite displacements of the adjacent pressure chambers 40 themselves that are caused by the proximate portions 39 disposed in the adjacent pressure chambers 40, respectively. Further, in this embodiment, in connection with the structure that the land 36 is disposed outside the pressure chamber area 40, the auxiliary electrode portions 37 extend straightly from the main electrode region 35*a* to the two other pressure chamber areas 40 adjacent to the land 36. Therefore, even if the pressure chambers 10 are arranged at a high density, the structural crosstalk can effectively be suppressed independently of the position of the land 36.

Further, in this embodiment, each pressure chamber 10 assumes a rhombic shape that is a kind of parallelogram having two acute angle portions and the connection electrode region 35*b* extends from the one acute angle portion of the main electrode region 35*a* which is similar to the pressure chamber 10. As seen from FIG. 11, the acute angle portions of the pressure chamber 10 (pressure chamber area 40) and their vicinities are places where an obstructive area 61 or an area 62 is less prone to occur because of the structure of the actuator units 21. Therefore, the structural crosstalk can be suppressed effectively even if the connection electrode region 35*b* extends to outside each pressure chamber area 40 in actuator units 21 in which the pressure chambers are arranged at a high density. In view of the fact that the magnitude of structural crosstalk to be induced is determined by the positional relationship between the obstructive areas 61 and the connection electrode region 35*b* extending to outside the pressure chamber area 40, in the case of this embodiment, it is preferable that the land 36 be disposed as close to the acute angle portions of the two adjacent pressure chamber areas 40 as possible.

As described above, the amount of variation, caused by the proximity portions 39, of the capacity of the pressure chamber 10 has some correlation with the area of the proximate portions 39. Therefore, it is also ideal that the area of the proximate portions 39 be such as to be able to just cancel out structural crosstalk that is induced when a drive voltage is applied. However, from the viewpoint of the uniformization of the ink discharge characteristic, the area of the proximate portions 39 may be such as to be able to partially cancel out the structural crosstalk, for example, to be able to cancel out the displacement (the magnitude of structural crosstalk) induced in the adjacent pressure chamber are as 40 by the land 36 and most of the connection electrode region 35*b*. In this embodiment, each of the auxiliary electrode portions 37 extends to the associated adjacent pressure chamber area 40 while overlapping with part of the closest obstructive area 61. Therefore, the area of the proximate portions 39 may be determined by taking into consideration the magnitude of structural crosstalk to be induced by the auxiliary electrode portions 37 themselves.

Figure 12:
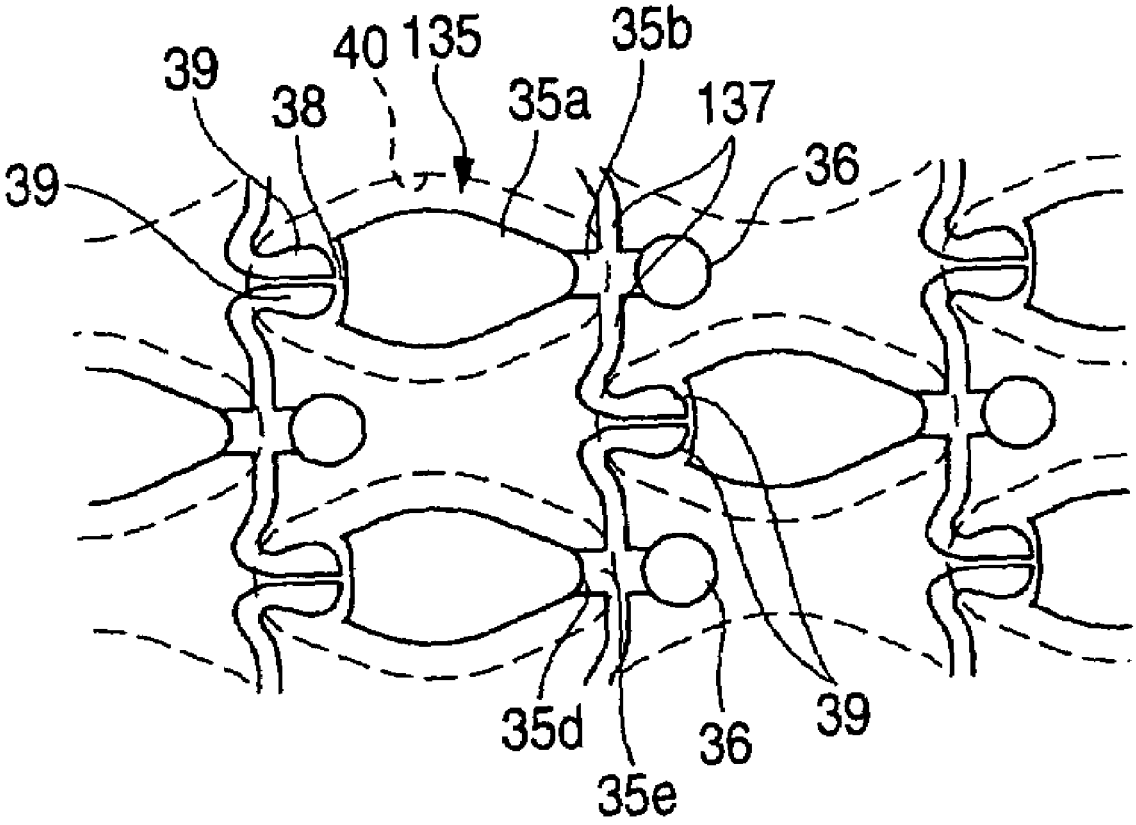
FIG. 12 is a plan view of part of each actuator unit of an ink-jet head according to a third embodiment of the invention.

Next, an ink-jet head according to a third embodiment of the invention will be described. FIG. 12 is a plan view of part of each actuator unit of the ink-jet head according to the third embodiment of the invention. The ink-jet head according to the third embodiment is different from the ink-jet head 1 according to the first embodiment only in the shapes of portions of each individual electrode (235). Therefore, the other components will be given the same reference symbols as in the first embodiment and will not be described in detail.

As shown in FIG. 12, individual electrodes 135 of this embodiment are like the individual electrodes 35 of the second embodiment and are different from the latter only in that auxiliary electrode portions 137 are different from the above-described auxiliary electrode portions 37 in the plan-view shape. Each individual electrode 135 has auxiliary electrode portions 137 that extend from a position, located between a boundary 35*d* and a land 36 provided at the tip of a connection electrode region 35*b*, of a proximate-to-boundary portion 35*e* located between a main electrode region 35*a* and the connection electrode region 35*b* toward two other individual electrodes 135, respectively, that are located adjacent to the individual electrode 135 concerned on both sides of the land 36. Like the above-described auxiliary electrode portions 37, the two auxiliary electrode portions 137 are formed for the one individual electrode 135, and proximate portions 39 are formed at the tips of the respective auxiliary electrode portions 137 so as to be located in main-electrode-lacking regions 38 of pressure chamber areas 40 where the adjacent main electrode regions 35*a* are provided, respectively. Like the above-described individual electrode 35, the individual electrode 135 are not connected to other, adjacent individual electrodes 135; accordingly, in the main-electrode-lacking region 38 concerned, the main electrode region 35*a* is located close to two proximate portions 39 connected to two adjacent individual electrodes 135 but is electrically independent of the latter.

Figure 13:
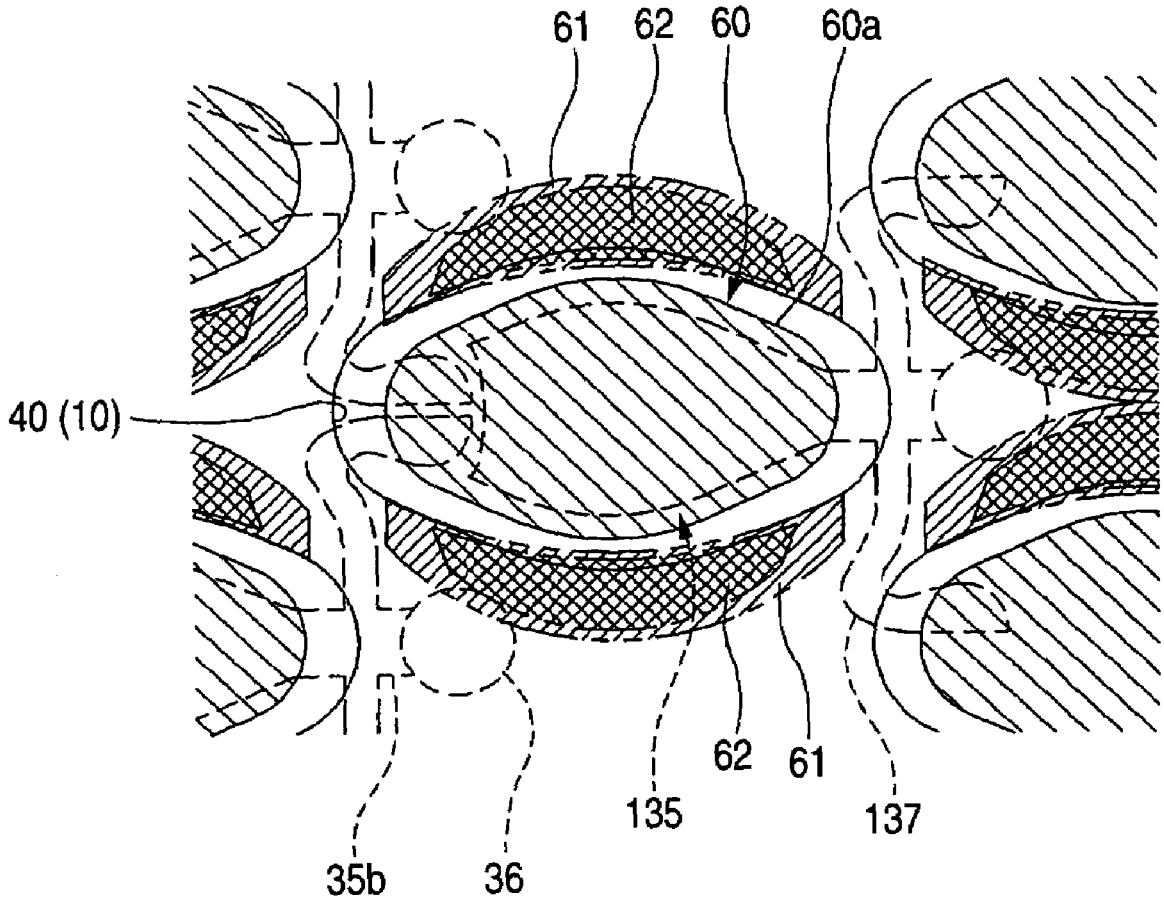
FIG. 13 shows areas that influence the capacity variation of each pressure chamber of the ink-jet head according to the third embodiment of the invention.

FIG. 13 shows areas that influence the capacity variation of each pressure chamber 10, in which individual electrodes 135 are drawn by broken lines. As shown in FIG. 13, the two auxiliary electrode portions 137 together assume a plan-view shape that is generally curved like a U-shape so as to avoid portions close to the obtuse angle portions of the pressure chamber area 40. This is to dispose the auxiliary electrode portions 137 in such a manner that they avoid, that is, have no overlaps with, the areas 61 and 62 that influence the capacity variation of the pressure chamber 10. In this embodiment, the auxiliary electrode portions 137 extend from the connection electrode region 35*b* rather than the main electrode region 35*a* to avoid the obstructive areas 61. With this measure, although there structural crosstalk that is inducted by the land 36 still exists, the adverse effect of the displacements of active layers right under the auxiliary electrode portions 137 excluding the proximate portions 39 on the capacity variations of the pressure chambers 10 opposed to the adjacent individual electrodes 135 can be reduced when a voltage is applied to the auxiliary electrode portions 137 via the land 36. This effectively suppresses the structural crosstalk because useless displacements of the active layers right under the auxiliary electrode portions 137 excluding the proximate portions 39 are less prone to influence the capacity variations of the adjacent pressure chambers 10. That is, in this embodiment, when a drive voltage is applied, displacements that are induced so as to obstruct the ink droplet discharge in the adjacent pressure chamber areas 40 (pressure chambers 10) are canceled out by opposite displacements of the adjacent pressure chambers 40 themselves that are caused by the proximate portions 39 disposed in the adjacent pressure chambers 40, respectively. Further, in connection with the structure that the land 36 is disposed outside the pressure chamber area 40, the curved auxiliary electrode portions 137 extend from the connection electrode region 35*b* to the two other pressure chamber areas 40 adjacent to the land 36. Therefore, even if the pressure chambers 10 are arranged at a high density, the structural crosstalk can more effectively be suppressed independently of the positions of the connection electrode region 35*b* and the land 36.

EXAMPLES

Next, a description will be made of results of investigations into variations of the ink droplet discharge speed that occur when the same prescribed voltage is applied to the individual electrodes 35 and 135 of the ink-jet head according to the second and third embodiments. A subject of analysis was analyzed by utilizing a finite element method taking the piezoelectricity into consideration. More specifically, a subject of analysis was divided into minute regions, and volume variations in surrounding pressure chamber areas that were caused by a variation in a minute region concerned when an external electric field was applied to the individual minute regions were determined in advance. Then, the minute regions were combined with assumed surface electrodes (individual electrodes) and accumulated volume variation values of the respective pressure chamber areas corresponding to those structures. Materials used in the analyses were PZT (piezoelectric sheets) that is modeled as an xy-isotropic, z-polarization type, an Ag—Pd alloy (internal electrode (common electrode)), gold (surface electrodes), and stainless steel (flow passage plates). As for the boundary conditions, it was assumed that 0 V was applied to a contact of the internal electrode and 20 V was applied to contacts of surface electrodes and symmetry was set for boundaries. Analyses were performed while the thickness of each PZT layer were varied in a range of 8 to 20 μm with a step of several micrometers. It was assumed that the internal electrode and the surface electrodes have thicknesses of 2 μm and 1 μm, respectively. It was also assumed that each subject of analysis had a predetermined expanse that is substantially influenced by crosstalk, and a model employed is such that eight rhombic regions surround a single, central rhombic region as shown in FIG. 14 or 15.

Example 1

Figure 14:
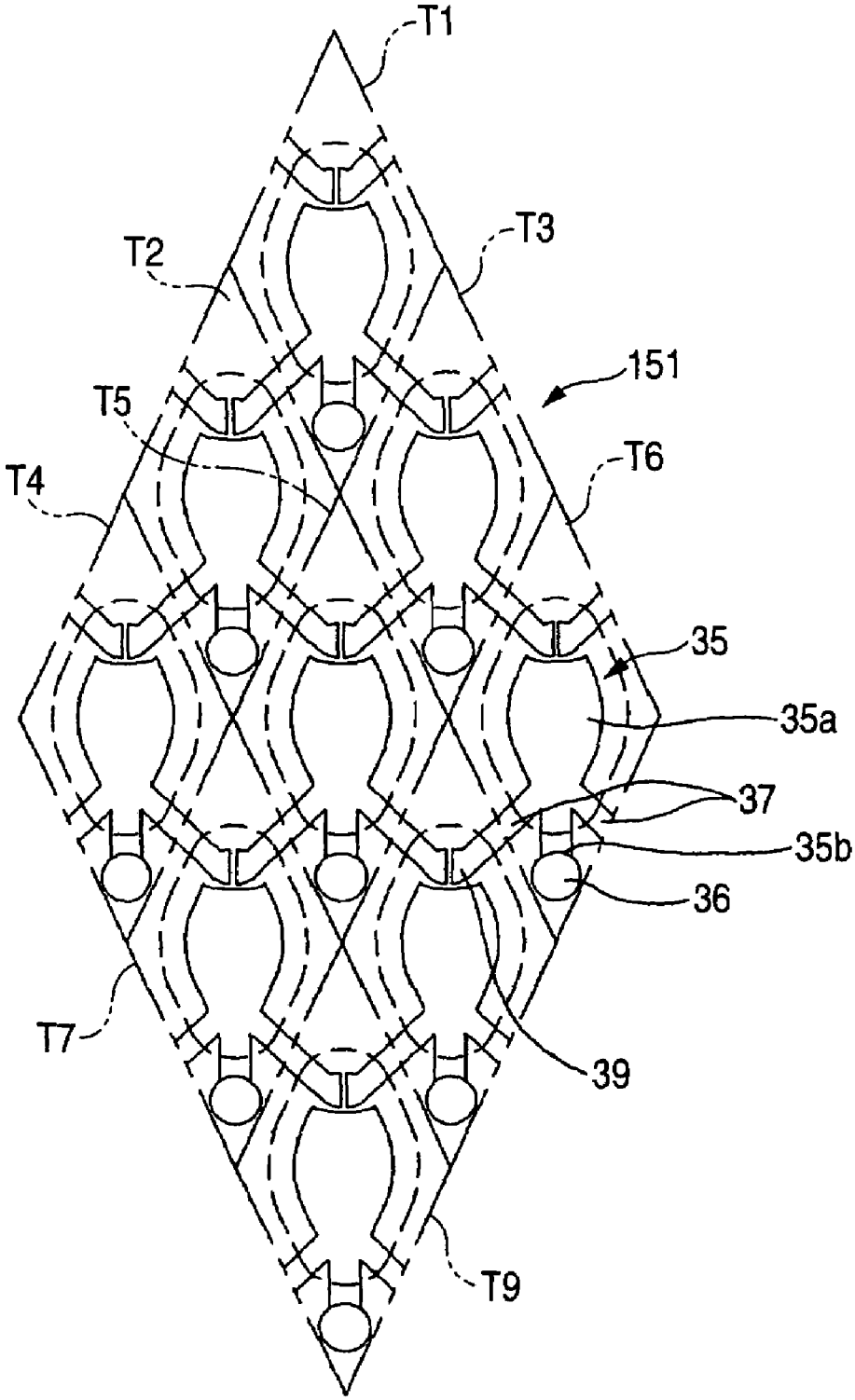
FIG. 14 is a plan view of an actuator unit as an analysis model of the ink-jet head according to the second embodiment of the invention.

FIG. 14 is a plan view of an actuator unit 21 as an analysis model of the ink-jet head according to the second embodiment of the invention. As in the case of FIG. 11, nine individual electrodes 35 are arranged adjacent to each other so as to form a rhombic region 151. The region 151 has nine divisional regions T1-T9 each of which is provided with one individual electrode 35. Each of the regions T1-T9 is similar to the region 151. A case was assumed that ink droplet discharge by the central individual electrode 35 (region T5) among the nine individual electrodes 35 influenced capacity variations of the eight pressure chambers 10 adjacent to the outer circumference of this individual electrode 35, and variations of the ink droplet discharge speeds of the eight individual electrodes 35 with respect to the ink droplet speed of the central individual electrode 35 were analyzed. A case that individual electrodes that were not provided with the auxiliary electrode portions 37 were arranged in the same manner as in this Example was analyzed as a Comparative Example in the same manner. Analysis values of Example 1 and Comparative Example are shown in Table 1.

TABLE 1

| | Region | | | | | | | | Sum of absolute values of |
|---|---|---|---|---|---|---|---|---|---|
| | T1 (T11) | T2 (T12) | T3 (T13) | T4 (T14) | T6 (T16) | T7 (T17) | T8 (T18) | T9 (T19) | respective regions |
| Example 1 | 0.03% | −0.78% | −0.77% | −1.65% | −1.80% | 0.47% | 0.26% | −0.20% | 5.96% |
| Example 2 | 0.02% | −0.75% | −0.75% | −1.38% | −1.37% | 0.14% | −0.13% | −0.15% | 4.69% |
| Comp. Example | −0.01% | −0.93% | −0.99% | −0.88% | −0.88% | −2.74% | −2.37% | −0.05% | 8.85% |

* Parenthesized symbols in the boxes of regions are region symbols of Example 2.

In Comparative Example shown in Table 1, when ink droplet discharge was performed by applying a voltage to the individual electrode 35 in the region T5, it greatly influenced capacity variations of the pressure chambers 10 that are opposed to the individual electrodes 35 in the regions T7 and T8. Since the lands 36 are located outside the pressure chamber areas 40 and no correction effect of the auxiliary electrode portions 37 is obtained, the ink droplet discharge speeds of the individual electrodes 35 in the regions T7 and T8 were lower than the ink droplet discharge speed of the individual electrode 35 in the region T5 by 2.78% and 2.37%, respectively, and were much different than those of the individual electrode 35 in the other regions T1-T4, T6, and T9. The sum of the absolute values of variations of the ink droplet discharge speeds of the regions T1-T4 and T6-T9 amounted to 8.85%. That is, in Comparative Example, the ink droplet discharge speeds had large variations in the regions T7 and T8 whose pressure chamber areas 40 are located on both sides of the land 36 in the region T5 and the ink droplet discharge speeds had large variations as a whole. In contrast, in Example 1 shown in Table 1, when ink droplet discharge was performed by applying a voltage to the individual electrode 35 in the region T5, the ink droplet discharge speeds of the individual electrodes 35 in the regions T7 and T8 were higher than the ink droplet discharge speed of the individual electrode 35 in the region T5 by 0.47% and 0.26%, respectively, and the differences between variations of the ink droplet discharge speeds were much smaller than in Comparative Example. This is because the active layers right under the proximate portions 39 of the auxiliary electrode portions 37 that extend from the main electrode region 35*a* in the region T5 to the regions T7 and TB are displaced, whereby capacity variations of the pressure chambers 10 in the regions T7 and T8 that are induced by a displacement of the active layer right under the land 36 and the connection electrode region 35*b* of the individual electrode 35 in the region T5 is canceled out Further, the sum of the absolute values of variations of the ink droplet discharge speeds of the regions T1-T4 and T6-T9 amounted to 5.96%, which is smaller than in Comparative Example. As shown in Table 1, the analysis values of the regions T4 and T6 of Example 1 are about two times larger than those of Comparative Example (in the negative direction). This is because the portions, excluding the proximate portions 39, of the auxiliary electrode portions 37 extending from the main electrode region 35*a* are located outside the reference line 60*a* (see FIG. 11) and hence negatively influence the pressure chambers 10 in the regions T4 and T6 that are relatively close to the auxiliary electrodes 37. However, the variations of the ink droplet discharge speeds are decreased as a whole.

Embodiment 2

Next, variations of the ink droplet discharge speeds of the individual electrodes 135 of the ink-jet head according to the third embodiment will be described FIG. 15 is a plan view of an actuator unit 21 as an analysis model of the ink-jet head according to the third embodiment of the invention. As in the case of FIG. 15, nine individual electrodes 135 are arranged adjacent to each other so as to form a rhombic region 171. As in the case of Example 1, each of divisional regions T11-T19 of the region 171 is provided with one individual electrode 135. Each of the regions T1-T9 is similar to the region 171. A case was assumed that ink droplet discharge by the central individual electrode 135 (region TIS) among the nine individual electrodes 135 influenced capacity variations of the eight pressure chambers 10 adjacent to the outer circumference of this individual electrode 135, and variations of the ink droplet discharge speeds of the eight individual electrodes 135 with respect to the ink droplet speed of the central individual electrode 135 were analyzed. Resulting analysis values of Example 2 are shown in Table 1. In Table 1, symbols of the respective regions of this Example are parenthesized in the boxes of regions.

In Example 2 shown in Table 1, when ink droplet discharge was performed by applying a voltage to the individual electrode 135 in the region T15, the ink droplet discharge speeds of the individual electrodes 135 in the regions T7 and T8 had variations of 0.14% and −0.13%, respectively, with respect to the ink droplet discharge speed of the individual electrode 135 in the region T15 by 0.47% and 0.26%, respectively, and the magnitudes of the variations of the ink droplet discharge speeds were much smaller than in Comparative Example. This is because the active layers right under the proximate portions 39 of the auxiliary electrode portions 37 that extend from the main electrode regions 135*a* in the region T15 toward the individual electrodes 135 in the regions T17 and T18 are displaced, whereby capacity variations of the pressure chambers 10 in the regions T17 and TIS that are induced by a displacement of the active layer right under the land 36 and the connection electrode region 35*b* in the region T15 is canceled out. This is the same as in Example 1. a comparison between the analysis values of Examples 1 and 2 show that the variations of the ink droplet discharge speeds of the regions T17 and T18 with respect to the ink droplet discharge speed of the region T15 in Example 2 are smaller than the corresponding variations in Example 1. This is because as shown in FIG. 13 the auxiliary electrode portions 137 extend toward the adjacent individual electrodes 135 so as to avoid the obstructive areas 61 and 62. Further, the sum of the absolute values of variations of the ink droplet discharge speeds of the regions T11-T14 and T16-T19 amounted to 4.69%, which is smaller than in Comparative Example and even Example 1. As shown in Table 1, as in the case of Example 1, the analysis values of the regions T14 and T16 of Example 2 are larger than those of the regions T4 and T6 of Comparative Example. However, as in the case of Example 1, the variations of the ink droplet discharge speeds are decreased as a whole. The analysis values of the regions T14 and T16 of Example 2 are smaller than those of the regions T4 and T6 of Example 1.

As described above, the analysis results of Examples 1 and 2 show that each sum of the analysis values is smaller than the sum of the values of the respective regions of comparative Example, which verifies the effect of the proximate portions 38 (auxiliary electrode portions 37 and 137) of the individual electrodes 35 and 135. Capacity variations of the pressure chambers 10 opposed to the individual electrodes 35 or 135 of the regions T7 and T8 or the regions T17 and T18 that are caused by displacements of the active layers right under the proximate portions 39 can be canceled out by capacity variations of the same pressure chambers 10 that are induced by the land 36 and the connection electrode regions 35*b* in the region T5 or T15, whereby the structural crosstalk is suppressed and hence the variations of the ink droplet discharge speeds are reduced. Therefore, the volumes and speeds of discharged ink droplets can be made almost uniform.

The preferred embodiments of the invention have been described above, but the invention is not limited to those embodiments and various design modifications are possible within the scope of the claims. For example, instead of disposing the proximate portions 39 at the tips of the auxiliary electrode portions 37, 137, or 237 of the individual electrodes 35, 135, or 235, proximate portions may be disposed at halfway positions of the auxiliary electrode portions. The auxiliary electrode portions 37 or 137 may be formed not only on the side where the connection electrode region 35*b* of the individual electrode 35 or 135 is formed (second or third embodiment) but also on the side where the connection electrode region 35*b* of the individual electrode 35 or 135 is not formed. Or the auxiliary electrode portions 37 or 137 may also extend from the central portion of the main electrode region 35*a*. It is appropriate to provide at least one auxiliary electrode region 37, 137, or 237 for each individual electrode 35, 135, or 235. Another modification is such that the auxiliary electrode portions 37 or 137 extend from the tip of the connection electrode region 35*b* toward the adjacent individual electrodes 35 or 135.

What is claimed is:

1. An ink-jet head comprising:

a flow passage unit in which a plurality of pressure chambers that communicate with respective nozzles are arranged parallel with a plane in matrix form; and an actuator unit that is fixed to one surface of the flow passage unit, for varying capacities of the respective pressure chambers, the actuator unit including;

a plurality of individual electrodes having a plurality of main electrode regions that are provided inside respective pressure chamber areas that the respective pressure chambers are taken over on the plane; and connection electrode regions that are connected continuous to the respective main electrode regions and signal lines;

a common electrode that covers an area where the pressure chambers are formed; and at least one piezoelectric sheet that covers the pressure chambers and is interposed between the common electrodes and the individual electrodes, wherein each individual electrode is provided with an auxiliary electrode portion that is led out of the individual electrode toward another individual electrode adjacent to the individual electrode, and wherein the auxiliary electrode portion has a proximate portion that is located close to the adjacent individual electrode inside a pressure chamber area corresponding to the adjacent individual electrode.

2. The ink-jet head according to claim 1, wherein when a signal is applied to the individual electrode via a signal line, the proximate portion of the auxiliary electrode portion provides with the pressure chamber corresponding to the another individual electrodes a capacity variation that is opposite in direction to a capacity variation which the connection electrode region of individual electrodes provides with the pressure chamber corresponding to the another individual electrodes.

3. The ink-jet head according to claim 1, wherein the auxiliary electrode portion of each individual electrode is led out toward a main electrode region of the another individual electrodes, and wherein the auxiliary electrode portion has the proximate portion at a tip of the auxiliary electrode portion.

4. The ink-jet head according to claim 1, wherein the pressure chambers have, in a plan view, a substantially parallelogram shape having two acute angle portions, wherein a connection electrode region of the individual electrode extends from a position close to one acute angle portion of the pressure chamber corresponding to the individual electrode to outside the pressure chamber area corresponding to the individual electrode, and wherein the pressure chambers are located between respective main electrode regions of the two other individual electrodes.

5. The ink-jet head according to claim 4, wherein the respective auxiliary electrode portions of each individual electrodes are led out toward the two other individual electrodes that are located adjacent to the individual electrode on both sides of the connection electrode region.

6. The ink-jet head according to claim 4, wherein the proximate portion of the auxiliary electrode portion is located inside the pressure chamber area corresponding to the another individual electrode at a position close to the other acute angle portion where a connection electrode region is not disposed.

7. The ink-jet head according to claim 6, wherein the auxiliary electrode portion extends straightly from a position close to a boundary between the main electrode region and the connection electrode region toward the other acute angle portion of the pressure chamber corresponding to the another individual electrode.

8. The ink-jet head according to claim 7, wherein the connection electrode regions are at least partially located outside the respective pressure chamber areas that the respective pressure chambers are taken over on the plane.

9. The ink-jet head according to claim 6, wherein the auxiliary electrode portion extends from a position close to a boundary between the main electrode region and the connection electrode region so as to avoid an area adjoining an obtuse angle portion of the pressure chamber corresponding to the another individual electrode.

10. The ink-jet head according to claim 9, wherein the connection electrode regions are at least partially located outside the respective pressure chamber areas that the respective pressure chambers are taken over on the plane.

11. The inkjet-head according to claim 1, wherein the actuator unit is configured by laminating a plurality of piezoelectric sheets, wherein the plurality of piezoelectric sheets includes at least one active piezoelectric sheet and at least one inactive piezoelectric sheet, the at least one active piezoelectric sheet having active portions, each of the active portions sandwiched by one of the individual electrodes and the common electrode, the at least one inactive piezoelectric sheet not having the active portions, and wherein one of the plurality of piezoelectric sheets which is most distant from the flow passage unit is the active piezoelectric sheet and another one of the plurality of piezoelectric sheets which is proximal to the flow passage unit is the inactive piezoelectric sheet.

* * * * *